US007209698B2

(12) United States Patent
Tawada et al.

(10) Patent No.: US 7,209,698 B2
(45) Date of Patent: Apr. 24, 2007

(54) METHOD AND APPARATUS FOR IMAGE FORMING CAPABLE OF USING MINUSCULE SPHERICAL PARTICLES OF TONER, A PROCESS CARTRIDGE IN USE FOR THE APPARATUS AND A TONER USED IN THE IMAGE FORMING FOR OBTAINING AN IMAGE WITH A HIGH THIN LINE REPRODUCIBILITY

(75) Inventors: Takaaki Tawada, Yokohama (JP); Shinichi Kawahara, Tokyo (JP); Takeo Suda, Tokyo (JP); Chohtaroh Kataoka, Tokyo (JP); Keiichi Yoshida, Kawasaki (JP); Haruji Mizuishi, Tokyo (JP)

(73) Assignee: Ricoh Company, Ltd., Tokyo (JP)

( * ) Notice: Subject to any disclaimer, the term of this patent is extended or adjusted under 35 U.S.C. 154(b) by 0 days.

(21) Appl. No.: 10/922,963

(22) Filed: Aug. 23, 2004

(65) Prior Publication Data

US 2005/0152722 A1 Jul. 14, 2005

(30) Foreign Application Priority Data

Aug. 22, 2003 (JP) ..... 2003-298509

(51) Int. Cl.
*G03G 21/00* (2006.01)

(52) U.S. Cl. ..... 399/346; 399/343

(58) Field of Classification Search ..... 399/346
See application file for complete search history.

(56) References Cited

U.S. PATENT DOCUMENTS 4,435,074 A 3/1984 Midorikawa et al.
4,519,698 A 5/1985 Kohyama et al.
4,885,466 A 12/1989 Koichi et al.
5,493,365 A 2/1996 Matsui et al.
5,596,395 A 1/1997 Sawamura et al.

(Continued)

FOREIGN PATENT DOCUMENTS

EP 0 501 768 A1 9/1992

(Continued)

OTHER PUBLICATIONS

U.S. Appl. No. 10/588,957, filed Aug. 10, 2006, Suda et al.
U.S. Appl. No. 10/591,661, filed Sep. 5, 2006, Mizuishi et al.
U.S. Appl. No. 11/508,238, filed Aug. 23, 2006, Kawahara et al.

*Primary Examiner*—David M. Gray
*Assistant Examiner*—Ryan D. Walsh
(74) *Attorney, Agent, or Firm*—Oblon, Spivak, McClelland, Maier & Neustadt, P.C.

(57) ABSTRACT

An image forming apparatus includes an image bearing member configured to bear a toner image on a surface thereof. A charging mechanism is configured to uniformly charge the surface of the image bearing member. An intermediate transfer mechanism is configured to transfer the toner image from the image bearing member onto an image receiver. A cleaning mechanism is configured to clean the surface of the image bearing member after the toner image is transferred onto the image receiver. A lubricant supplying mechanism is configured to supply a lubricant contained therein onto the surface of the image bearing member and form a thin layer using a lubricating blade. The lubricant supplying mechanism is disposed between the cleaning mechanism and the charging mechanism.

58 Claims, 8 Drawing Sheets

U.S. PATENT DOCUMENTS 5,610,691 A 3/1997 Takahashi et al.
5,678,125 A 10/1997 Kutsuwada et al.
5,812,919 A 9/1998 Takano et al.
5,815,767 A 9/1998 Kutsuwada et al.
5,857,132 A 1/1999 Mizuishi et al.
5,887,224 A 3/1999 Mizuishi et al.
5,895,146 A * 4/1999 Waki et al. ..... 399/170
5,909,609 A 6/1999 Yahata et al.
5,915,143 A 6/1999 Watanabe et al.
5,915,156 A 6/1999 Kizaki et al.
5,923,936 A 7/1999 Tanoue et al.
5,950,062 A 9/1999 Yahata et al.
6,055,388 A 4/2000 Watanabe et al.
6,055,394 A 4/2000 Suda et al.
6,060,205 A * 5/2000 Takeichi et al. ..... 399/346
6,077,635 A * 6/2000 Okado et al. ..... 430/45
6,085,062 A 7/2000 Mizuishi et al.
6,097,914 A 8/2000 Tanaka et al.
6,101,351 A 8/2000 Suda et al.
6,128,449 A 10/2000 Zenba et al.
6,144,811 A 11/2000 Ohori et al.
6,144,822 A 11/2000 Yamaguchi et al.
6,148,161 A 11/2000 Usui et al.
6,160,969 A 12/2000 Ishigaki et al.
6,256,465 B1 7/2001 Yoshinaga et al.
6,266,501 B1 7/2001 Mizuishi et al.
6,295,437 B1 9/2001 Hodoshima et al.
6,336,013 B1 1/2002 Suda et al.
6,337,957 B1 1/2002 Tamaki et al.
6,463,237 B2 10/2002 Suda et al.
6,522,855 B1 2/2003 Katoh et al.
6,558,862 B2 * 5/2003 Kojima et al. ..... 399/346
6,560,414 B2 5/2003 Suda et al.
6,562,529 B1 * 5/2003 Kojima et al. ..... 399/346
6,611,671 B2 * 8/2003 Shoji ..... 399/346
6,628,903 B1 9/2003 Ohori et al.
6,706,459 B2 * 3/2004 Kojima et al. ..... 399/346
6,763,208 B2 7/2004 Nagatsuna et al.
2002/0106574 A1 * 8/2002 Haneda et al. ..... 430/124
2002/0159799 A1 * 10/2002 Kobayashi et al. ..... 399/302
2003/0049555 A1 * 3/2003 Sakon et al. ..... 399/346
2003/0049557 A1 * 3/2003 Itami et al. ..... 399/346
2003/0123905 A1 7/2003 Suda et al.
2003/0134220 A1 * 7/2003 Emoto et al. ..... 430/109.4
2003/0180071 A1 9/2003 Suda
2003/0215259 A1 11/2003 Suda et al.
2003/0219289 A1 11/2003 Kawahara et al.
2003/0235424 A1 12/2003 Kawahara et al.
2004/0009421 A1 1/2004 Mizuishi
2004/0013442 A1 1/2004 Suzuki et al.
2004/0042822 A1 3/2004 Fujishiro et al.
2004/0057059 A1 3/2004 Miura et al.
2004/0071475 A1 4/2004 Ohori et al.
2004/0141781 A1 7/2004 Suda
2004/0146309 A1 7/2004 Shu et al.
2005/0152722 A1 7/2005 Tawada et al.

FOREIGN PATENT DOCUMENTS

EP 1 276 020 A2 1/2003
JP 11-184340 7/1999
JP 2000-330443 11/2000
JP 2000330443 A * 11/2000
JP 2003-140518 5/2003

* cited by examiner

METHOD AND APPARATUS FOR IMAGE FORMING CAPABLE OF USING MINUSCULE SPHERICAL PARTICLES OF TONER, A PROCESS CARTRIDGE IN USE FOR THE APPARATUS AND A TONER USED IN THE IMAGE FORMING FOR OBTAINING AN IMAGE WITH A HIGH THIN LINE REPRODUCIBILITY

CROSS REFERENCE TO RELATED APPLICATIONS

The present application claims priority to Japanese patent application no. 2003-298509, filed in the Japanese Patent Office on Aug. 22, 2003, the disclosure of which is incorporated by reference herein in its entirety.

BACKGROUND OF THE INVENTION

1. Field of the Invention

The present invention relates to a method and apparatus for image forming, a process cartridge and a toner, and more specifically relates to a method and apparatus for image forming capable of improving transferability and cleanability by supplying a lubricant, and a process cartridge for use in the apparatus, and a toner used in the image forming for obtaining an image having high thin line reproducibility.

2. Discussion of the Background

Recently, color image forming apparatuses using an electrophotographic methods have been in wide use. Digitized images are widely available, and printed images having higher image definitions are desired. Higher image resolution and gradients are studied, and toners visualizing electrostatic latent images having desired circularity and smaller particle diameters can be used to form images having higher definitions. A toner particle having a small particle size with a spherical shape is suitable for obtaining higher definition images. However, the toner having a small particle size with the spherical shape can easily slip through a gap between a cleaning blade provided in a cleaning unit and a photoconductive element, and onto a surface of a photoconductive element. Due to a spherical surface of the toner particle, the surface of the photoconductive element may not be cleaned, and the residual toner particles are scattered in the color image forming apparatus, thereby contaminating an image forming component such as a charging roller. As a result, a defective image having black dots and background fogging may be produced.

To eliminate the above-mentioned problem, an electrophotographic image forming method has been proposed. In the electrophotographic image forming method, a cleaning member is included for cleaning residual toner on a photoconductive element by using an elastic rubber blade after transferring a toner image onto a recording medium. Zinc stearate is incorporated in the toner by an amount from approximately 0.01% to approximately 0.5% with reference to toner weight, and the elastic rubber blade is substantially held on a contacting surface side of a cleaning blade on the photoconductive element by a supporting member for fixing the elastic rubber blade on the cleaning member.

However, when the zinc stearate is added to the toner, a layer of the toner including the zinc stearate applied on the surface of the toner becomes uneven depending on a condition of an image to be developed, and defective images can be produced.

Another cleaning unit has been proposed such that the cleaning unit includes a brush roller arranged in contact with an electrophotographic photoconductive element on the upstream side of the cleaning blade in the rotating direction of the electrophotographic photoconductive element, and that lubricant scraped from a stick-shaped molded element is applied on the surface of the photoconductive element.

The cleaning unit uses an electro-conductive brush to apply the lubricant onto the surface of the photoconductive element. However, the lubricant and the toner adhere on the surface of the electro-conductive brush, and the lubricant and the toner are difficult to remove from the surface of the conductive brush. Thus, a coating ability of the lubricant deteriorates.

Another technique has been proposed such that an image forming apparatus includes a cleaning blade which contacts a surface of a first image bearing member. A lubricant supplying unit provided in the image forming apparatus is disposed downstream from the cleaning blade in the rotating direction of the first image bearing member, and supplies the lubricant to the surface of the first image bearing member. A leveling-off unit also provided in the image forming apparatus is disposed downstream from the lubricant supplying unit in the rotating direction of the first image bearing member, and levels off the lubricant supplied onto the surface of the first image bearing member. However, the above-mentioned structure requires a relatively large and complex cleaning unit. This image forming apparatus uses a contact-type charging roller. Therefore, a leveled lubricant contacts the charging roller. The lubricant contacting the charging roller is conveyed to the surface of the charging roller, on which the lubricant adheres and accumulates. This varies a resistance value of the charging roller, and prevents a regular charging. The lubricant including fatty acid metallic salts such as zinc stearate can easily be attached to material such as nitrile rubber and urethane rubber that are generally included in a charging roller. Even when a surface of the charging roller is coated with fluorochemical coating material to prevent adhesion of foreign materials on the surface thereof, adherent lubricant are accumulated because the lubricant directly contacts the surface of the charging roller. On the contrary, the contact of the lubricant with the charging roller may substantially shorten a useful life of the charging roller.

SUMMARY OF THE INVENTION

The present invention can overcome one or more of the above-noted disadvantages.

An object of the present invention is to provide an image forming apparatus which includes a lubricant supplying unit reducing a friction coefficient of an image bearing member to improve transferability and cleanability of the image forming apparatus by using a cleaning blade, and supplying lubricant to the image bearing member to form a thin layer on a surface of the image bearing member to effectively collect and reuse the unused lubricant, and/or which prevents contamination by the lubricant to a charging unit and other image forming members to uniformly charge the surface of the image bearing member.

Another object of the present invention is to provide a process cartridge for use in the above-mentioned image forming apparatus.

Another object of the present invention is to provide toner that has a small diameter and spherical shape, can be cleaned by a cleaning blade, and/or can produce a high quality image having high thin line reproducibility.

The present invention can provide an image forming apparatus that includes an image bearing member, a charging mechanism, an intermediate transfer mechanism, a cleaning mechanism, and a lubricant supplying mechanism. The image bearing member is configured to bear a toner image on a surface thereof. The charging mechanism is configured to uniformly charge the surface of the image bearing member. The intermediate transfer mechanism is configured to transfer the toner image from the image bearing member to an image receiver. The cleaning mechanism is configured to clean the surface of the image bearing member after the toner image is transferred to the image receiver. The lubricant supplying mechanism is configured to supply a lubricant contained therein to the surface of the image bearing member, and form a thin layer using a lubricating blade. The lubricant supplying mechanism is disposed between the cleaning mechanism and the charging mechanism.

The receiver may include a recording medium receiving the toner image directly from the image bearing member and an intermediate transfer member receiving the toner image from the image bearing member before transferring the toner image onto the recording medium. The intermediate transfer member is disposed in the intermediate transfer mechanism.

The lubricant supplying mechanism may include a supplying roller having a fibrous brush, and the supplying roller may apply the lubricant to the surface of the image bearing member before the lubricating blade forms the thin layer of the lubricant on the surface of the image bearing member.

The lubricant supplying mechanism may include a supplying roller having a plurality of films, and the supplying roller may apply the lubricant to the surface of the image bearing member before the lubricating blade forms the thin layer of the lubricant on the surface of the image bearing member.

The cleaning mechanism may include a plurality of cleaning units.

The plurality of cleaning units may include a primary cleaning unit provided at an uppermost stream in a moving direction of the image bearing member, and the lubricant supplying mechanism may be disposed downstream of the primary cleaning unit.

The cleaning mechanism may include a secondary cleaning unit disposed downstream of the primary cleaning unit and having a first cleaning blade, and the lubricant supplying mechanism may be disposed between the primary and secondary cleaning units.

The primary cleaning unit may include a second cleaning blade configured to exert a first predetermined contact pressure and the secondary cleaning unit includes the first cleaning blade configured to exert a second predetermined contact pressure, the second contact pressure may be less than the first contact pressure.

The lubricant supplying mechanism may be disposed in one of the plurality of cleaning units.

The lubricant supplying mechanism may include a member configured to mechanically apply one of a vibration and a shock.

The lubricant supplying mechanism may be disposed above a horizontal plane including a center position of the image bearing member.

The lubricant contained in the lubricant supplying mechanism may include a powder particle having a volume-based average particle diameter from approximately 0.1 mm to approximately 3.0 mm.

The lubricant may include a fatty acid metal salt having a metallic material and a fatty acid. The metallic materials may include one or more of zinc, iron, calcium, aluminum, lithium, magnesium, strontium, barium, cerium, titanium, zirconium, lead, and manganese, and/or the fatty acid may include one or more of lauric acid, stearic acid, palmitic acid, myristatic acid, and oleic acid.

The charging mechanism may include a charging member separated from the image bearing member by a predetermined distance and configured to apply a bias including a direct current superimposed by an alternate current to the charging member.

The toner may have a volume-based average particle diameter Dv of equal to or less than 10 μm and a distribution Ds from approximately 1.00 to approximately 1.40, and the distribution Ds may be defined by a ratio of the volume-based average particle diameter Dv to a number-based average particle diameter Dn, expressed as Dv/Dn.

The toner may have an average circularity of from approximately 0.93 to approximately 1.00.

The toner may have a first shape factor SF1 from approximately 100 to approximately 180 and a second shape factor SF2 from approximately 100 to approximately 180.

The toner may have a spindle outer shape, and have a ratio of a major axis r1 to a minor axis r2 from approximately 0.5 to approximately 1.0 and a ratio of a thickness r3 to the minor axis r2 from approximately 0.7 to approximately 1.0, and $r1 \geqq r2 \geqq r3$.

The toner may be obtained from an elongation and/or a crosslinking reaction of toner composition including a polyester prepolymer having a function group including nitrogen atom, a polyester, a colorant, and a releasing agent in an aqueous medium under resin fine particles.

In one exemplary embodiment, the present invention for provide a method for image forming includes the steps of providing an image bearing member in an image forming apparatus, charging a surface of the image bearing member uniformly using a charging mechanism, forming a toner image on a surface of the image bearing member, transferring the toner image using an intermediate transfer mechanism from the image bearing member to an image receiver, cleaning the surface of the image bearing member using a cleaning mechanism after the toner image is transferred to the image receiver, supplying a lubricant contained in a lubricant supplying mechanism to the surface of the image bearing member, and forming a thin layer using a lubricating blade.

In one exemplary embodiment, the present invention can provide a process cartridge for use in an image forming apparatus, that includes an image bearing member configured to bear a toner image on a surface thereof, at least one image forming component integrally mounted in a vicinity of or adjacent the image bearing member, and a lubricant supplying mechanism configured to supply a lubricant contained therein onto the surface of the image bearing member and to form a thin layer using a lubricating blade.

The at least one image forming component may include one or more of a charging unit, a developing unit and a cleaning unit. The lubricant supplying mechanism may be disposed between the cleaning unit and the charging unit. The process cartridge may be detachable from the image forming apparatus.

The present invention can further provide a toner used for an image forming apparatus including an image bearing member configured to bear a toner image on a surface thereof, a charging mechanism configured to uniformly charge the surface of the image bearing member, an intermediate transfer mechanism configured to transfer the toner image from the image bearing member to an image receiver, a cleaning mechanism configured to clean the surface of the image bearing member after the toner image is transferred to the image receiving medium, and/or a lubricant supplying mechanism configured to supply a lubricant contained therein to the surface of the image bearing member and to form a thin layer using a lubricating blade, the lubricant supplying mechanism disposed between the cleaning mechanism and the charging mechanism.

The toner may a volume-based average particle diameter Dv of equal to or less than 10 μm and a distribution Ds from approximately 1.00 to approximately 1.40, wherein the distribution Ds is defined by a ratio of the volume-based average particle diameter Dv to a number-based average particle diameter Dn, expressed as Dv/Dn.

BRIEF DESCRIPTION OF THE DRAWINGS

A more complete appreciation of the present invention and one or more of the attendant advantages thereof will be readily ascertained and/or obtained as the same becomes better understood by reference to the following detailed description when considered in connection with the accompanying drawings, wherein.

DETAILED DESCRIPTION OF THE PREFERRED EMBODIMENTS

Figure 1:
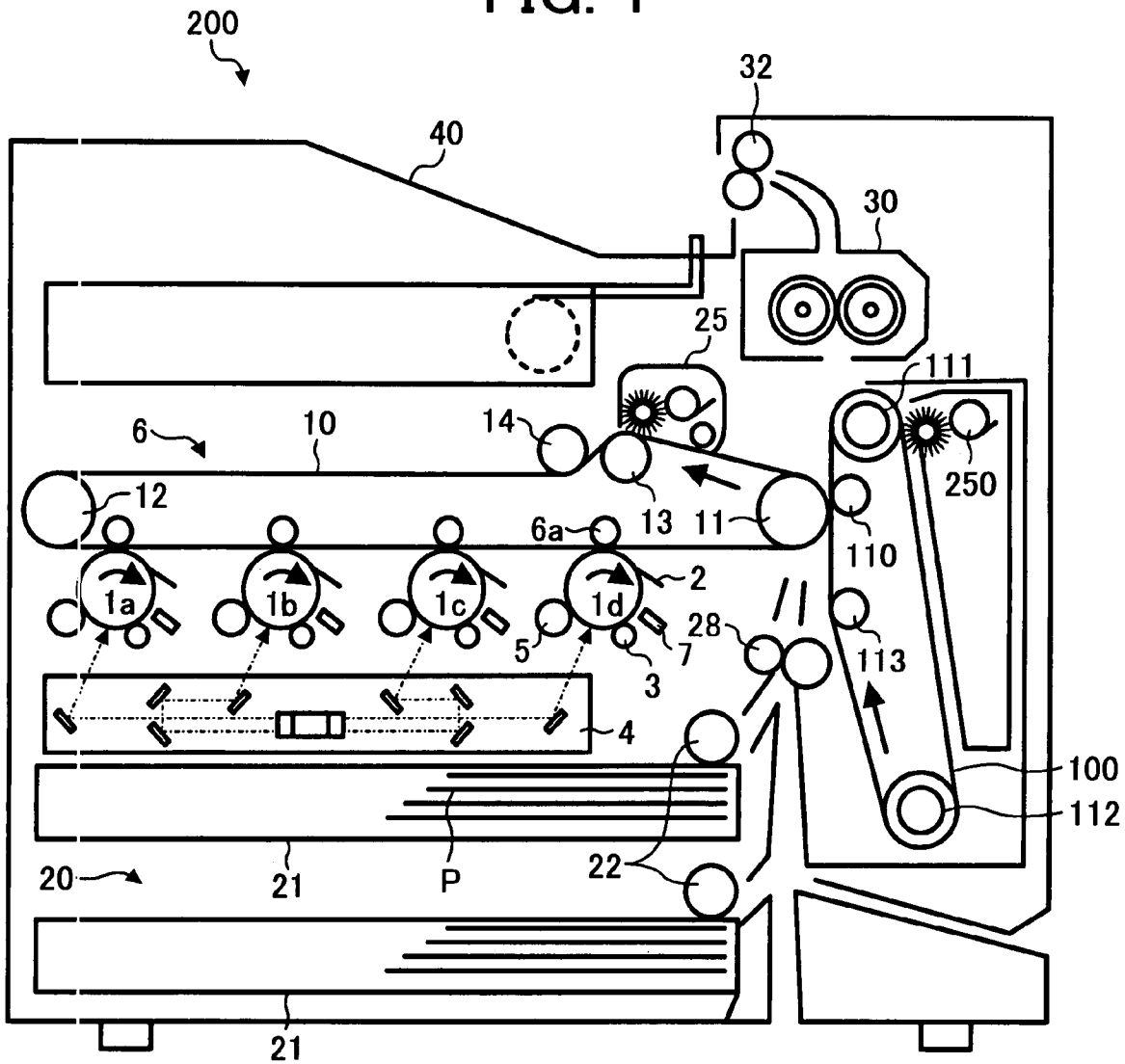
FIG. 1 is a schematic structure of an image forming apparatus according to an embodiment of the present invention.

In describing preferred embodiments illustrated in the drawings, specific terminology is employed for clarity. However, the disclosure is not intended to be limited to the specific terminology, and it is to be understood that each specific element includes all technical equivalents that operate in a similar manner.

Referring now to the drawings, wherein like reference numerals designate identical or corresponding parts throughout the several views, preferred embodiments of the present invention are described.

Referring to FIG. 1, a structure of an image forming apparatus 200 according to an embodiment of the present invention is described.

In FIG. 1, the image forming apparatus 200 includes four photoconductive elements 1*a*, 1*b*, 1*c* and 1*d*, serving as image bearing members. The four photoconductive elements 1*a*, 1*b*, 1*c* and 1*d* have similar structures and functions, except that respective toners are of different colors (for example yellow, cyan, magenta and black toners). The discussion below uses reference numerals for specifying components of the printer or image forming apparatus 200 without suffixes. The image forming apparatus 200 further includes image forming components such as a cleaning unit 2, a charging unit 3, an optical writing unit 4, a developing unit 5, a transfer unit 6, and a lubricant supplying unit 7. The cleaning unit 2, the charging unit 3 and the developing unit 5 are disposed around the photoconductive element 1. Further details are provided below, in reference to FIG. 2.

A space between the charging unit 3 and the developing unit 5 provides an optical path allowing optical data output by the optical writing unit 4 to pass through.

As shown in FIG. 1, the photoconductive element 1 is rotatably provided to the image forming apparatus 200 and rotates in a direction indicated by an arrow in FIG. 1.

A surface of the photoconductive element 1 is partly held in contact with a surface of an intermediate transfer belt 10 included in the transfer unit 6. The photoconductive element 1 has a layer of an organic semiconductor, which is a photoconductive material, on a surface of an aluminum cylindrical shape having a diameter of from approximately 30 mm to approximately 100 mm. As an alternative, a photoconductive element having a surface layer made of amorphous silicon may be employed. Further, while a drum-type photoconductive element is employed in FIG. 1, a belt-type photoconductive element may alternatively be applied to the image forming apparatus 200 of the present invention.

The optical writing unit 4 includes a known laser method in which optical data corresponding to color image forming is emitted in a form of a laser beam. The laser beam irradiates an electrostatic latent image on the photoconductive element 1 having a uniformly charged surface. Alternately, the optical writing unit 4 may have LED array and imaging unit.

The intermediate transfer belt 10 is movable in a direction indicated by an arrow in FIG. 1. The intermediate transfer belt 10 is disposed above the photoconductive elements 1*a*, 1*b*, 1*c* and 1*d*, and is supported by supporting rollers 11, 12 and 13. The intermediate transfer belt 10 forms an endless belt extended with the supporting rollers 11, 12 and 13, rotating in a direction, indicated by an arrow in FIG. 1. A primary transfer roller 6*a* is disposed in a vicinity of or adjacent to the photoconductive element 1, and is held in contact with an inside surface of a belt loop of the intermediate transfer belt 10. In addition, at least one tension roller may also be provided to further extend the intermediate transfer belt 10.

The primary transfer roller 6*a* used in the image forming apparatus 200 according to the present invention is a roller applying a high voltage to the intermediate transfer belt 10. Alternately, a charger that discharges static electricity to the intermediate transfer belt 10 may be employed. Preferably, one or more of the above-mentioned rollers, except for the primary transfer roller 6*a*, is grounded to prevent producing a defective image. The defective image may be produced when toner is frictionally charged with the intermediate transfer belt 10 and is emigrated to a recording medium.

Preferably, the intermediate transfer belt 10 includes a base material made of a heat resistant material, such as a resin film and a rubber, having a thickness of from approximately 20 μm to approximately 600 μm. It is also preferable that the intermediate transfer belt 10 includes a resistance value which can statistically transfer the toner from the photoconductive element 1, and has a surface roughness Rz1 of from approximately 1 μm to approximately 4 μm.

A cleaning unit 25 may be disposed on an outer side of the belt loop of the intermediate transfer belt 10 to remove residual toner remaining on a surface of the intermediate transfer belt 10. In addition, a tension roller 14 may also be held in contact with the intermediate transfer belt 10. The tension roller 14 can smoothly move the intermediate transfer belt 10, such that the intermediate transfer belt is held taut and/or prevented from sagging, which reduces unevenness of toner in a transferring operation and eccentricity of the intermediate transfer belt 10 while the intermediate transfer belt is moving. The supporting roller 11 may be used as a secondary transfer member that includes a heating element. Preferably, when the supporting roller 11 employs the heating element, the tension roller 14 includes a heat pipe as a cooling element for cooling the intermediate transfer belt 10 so that the photoconductive element 1 is not highly heated.

A conveyance belt 100 is disposed at a right portion of the image forming apparatus 200 of FIG. 1. The conveyance belt 100 is rotatably movable in a direction indicated by an arrow in FIG. 1, and forms an endless belt extended with rotation rollers 111, 112, and 113. A secondary transfer roller 110 is also held in contact with an inside surface of a belt loop of the conveyance belt 100. The secondary transfer roller 110 is a roller having a surface covered with a conductive rubber, and applies a bias to the conveyance belt 100 to transfer. The conveyance belt 100 includes a heat resistant base material made of a heat resistant material, such as a resin film and a rubber, having a thickness of from approximately 20 μm to approximately 600 μm. Preferably, the conveyance belt 100 has a contact angle of 90 degrees with respect to toner and a surface roughness Rz2 of from approximately 5 μm to approximately 10 μm. As the secondary transfer roller 110, an elastic roller may be employed. In this case, the intermediate transfer belt 10 and the conveyance belt 100 can form a nip between the supporting roller 11 including a heat element and the elastic roller 110. With the above-mentioned structure, a first toner image is formed on the surface of the intermediate transfer belt 10 as a front side image of a transfer paper P and is transferred onto a surface of the conveyance belt 100. A second toner image is then formed on the surface of the intermediate transfer belt 10 as a back side image of the transfer paper P. When the transfer paper P is conveyed to the nip, the first toner image formed on the surface of the conveyance belt 100 and the second toner image formed on the surface of the intermediate transfer belt 10 are simultaneously transferred onto front and back sides of the transfer paper P, respectively.

The image forming apparatus 200 further includes a sheet feeding mechanism 20 as shown in FIG. 1. The sheet feeding mechanism 20 of FIG. 1 includes two sheet feeding cassettes 21, two pickup rollers 22, and a registration roller pair 28.

After passing through the sheet feeding mechanism 20, the transfer paper P goes through a fixing unit 30 and a sheet discharging roller 32, and is discharged to a sheet discharging tray 40.

Figure 2:
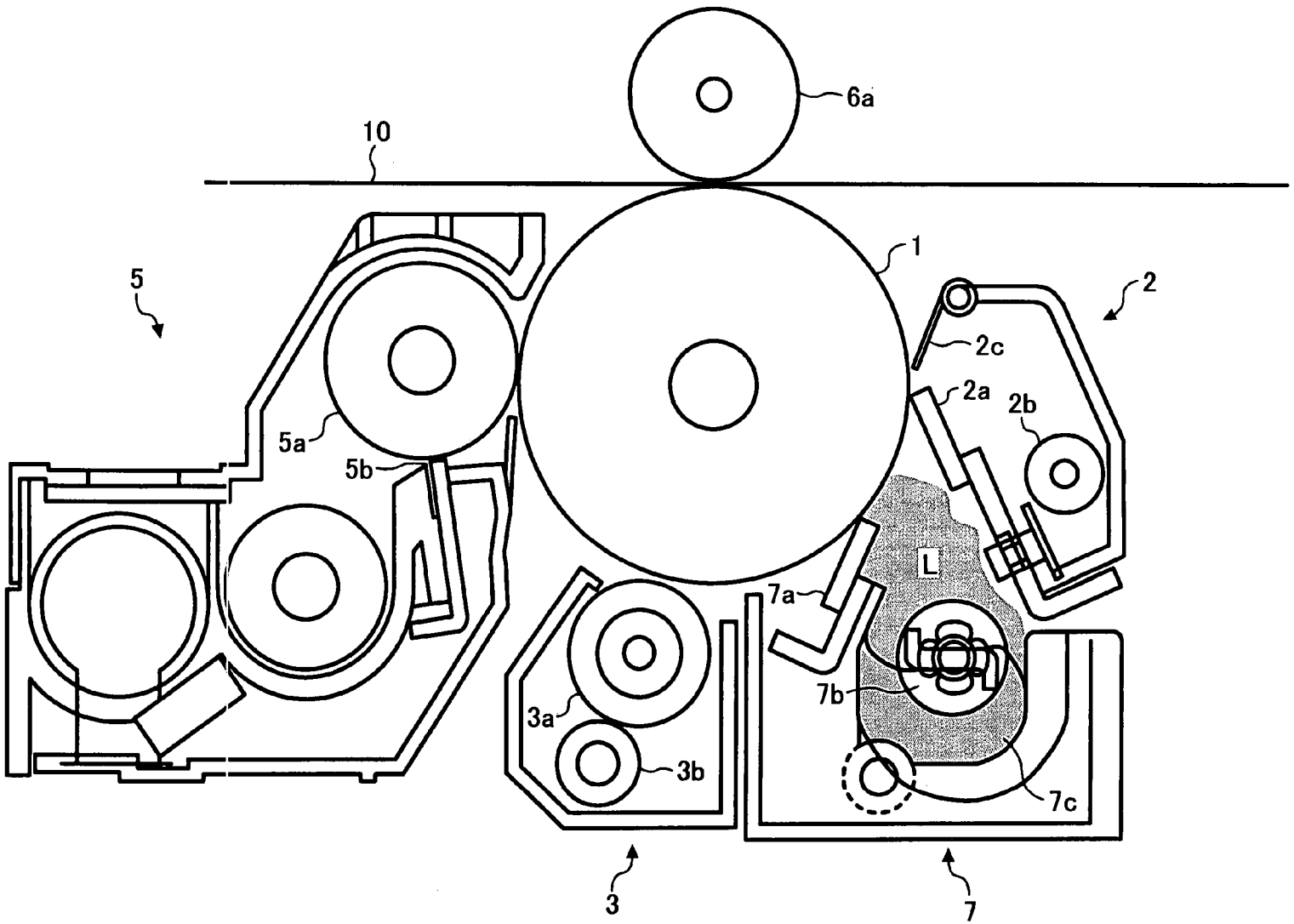
FIG. 2 is a cross sectional view of a structure of an image bearing member and image forming components provided in the image forming apparatus of FIG. 1.

Referring to FIG. 2, a structure of the photoconductive element 1 and other image forming components disposed around the photoconductive element 1 is described.

The charging unit 3 includes a charging roller 3*a* and a charge cleaning roller 3*b*.

The charging roller 3*a* is arranged to have a predetermined distance from a surface of the photoconductive element 1.

The developing unit 5 includes a developing sleeve 5*a* and a doctor blade 5*b*.

The cleaning unit 2 includes a cleaning blade 2*a*, a cleaning film 2*b*, and a conveying auger 2*c*.

In FIG. 2, the lubricant supplying unit 7 containing lubricant is disposed separately or apart from the cleaning unit 2. The lubricant supplying unit 7 includes a lubricating blade 7*a*, a lubricant supplying roller 7*b*, and a lubricant container 7*c*.

The lubricant supplying roller 7*b* includes a film supplying lubricant L onto the photoconductive element 1. The lubricating blade 7*a* smoothes the lubricant L supplied on the photoconductive element 1 to form a thin layer. The lubricant container 7*c* contains the lubricant L.

The lubricant supplying roller 7*b* is a cylindrical metal roller having a surface covered by a plurality of resin films. Alternatively, the roller may have a surface covered by a brush. Suitable materials for the resin film include polyester resins, fluorocarbon resins, styrene resins, and acrylate resins. Suitable materials for the brush include polyester resins, fluorocarbon resins, styrene resins, acrylate resins, and polyamide resins, such as nylon, which have good wearing resistance and a high hardness. To prevent friction charging, conductive powder such as carbon black (e.g., acetylene black and furnace black), graphite, and metals powders (e.g., copper and silver), can be used. Preferably, the electric resistance of the brush is from approximately $10^2$ Ωcm to approximately $10^8$ Ωcm. Specific examples of the lubricating blade 7*a* include a blade made of an elastomer such as fluorocarbon resins, urethane resins, and silicone resins. Among these resins, urethane resins are preferable because urethane resins are highly elastic and resistant to wear. The lubricating blade 7*a* may be held in contact with the photoconductive element 1 in a counter method or in a trailing method. The counter method is preferable because the counter method does not turn the lubricating blade 7*a* outward, so that the lubricant L can uniformly be formed as a thin layer. A contact pressure is from approximately 5 N/m to approximately 30 N/m, and a contact angle is from approximately 10 degrees to approximately 30 degrees. Other conditions such as impression can be determined according to a ratio of elasticity of the lubricating blade 7*a*. However, to form a thin layer of the lubricant L having a low hardness, the contact pressure may be lower than that of the cleaning blade 2*a*.

In the lubricant supplying unit 7, the lubricant supplying roller 7*b* receives the lubricant L contained in the lubricant container 7*c* and conveys the lubricant L onto the film of the lubricant supplying roller 7*b* to the surface of the photoconductive element 1. The lubricating blade 7*a* held in contact with the photoconductive element 1 smoothes the lubricant L to form a thin layer.

With the above-mentioned structure, a friction coefficient of the photoconductive element 1 can be reduced, a transfer ratio of the toner can be improved, and an amount of toner to be disposed can be reduced. Further, a spherical toner particle that is generally difficult to be removed can be cleaned. In addition, by forming a thin layer with the lubricating blade 7*a*, unnecessary lubricant L is blocked by the lubricant blade 7*a* so that an amount of lubricant L is controlled to form the thinnest layer on the photoconductive element 1. At this time, the lubricant L unused for forming the thin layer remains on the lubricating blade 7*a*. Therefore, the lubricant L of the lubricant container 7*c* may be collected to the lubricant container 7*c* and is repeatedly used.

Specific examples of the lubricant L are metal salts of fatty acids such as lead oleate, zinc oleate, copper oleate, zinc stearate, cobalt stearate, iron stearate, copper stearate, zinc palmitate, copper palmitate, and zinc linoleate; fluorine resin particles such as polytetrafluoroethylene, polychlorotrifluoroethylene, polyvinylidenefluoride, polydichloro difluoroethylene, tetrafluoroethylen-ethylene copolymers, and tetrafluoroethylene-hexafluoropropylene copolymers. The metal salts of fatty acids are preferable to substantially reduce friction of the photoconductive element 1. Among these metal salts, zinc stearate, calcium, and/or calcium stearate is preferred.

The lubricant L used in the above-mentioned operation is in a powder form having a volume-based average particle diameter from approximately 0.1 mm to approximately 3.0 mm. Since a molded lubricant L may need to be strongly rubbed to become powder to scrape and to be supplied to the photoconductive element 1, a useful life of the brush may be short. Also, a drive shaft (not shown) and a gear (not shown) may be increased in strength. Therefore, manufacturing costs may not be able to be reduced. By using the lubricant L in the powder form, a useful life of the lubricant supplying roller 7*b* including a film or a brush can be long and the useful life of the lubricant supplying unit 7 can be extended. Also, by reducing a volume-based average particle diameter of the powder lubricant L, the lubricating blade 7*a* can easily thin the lubricant L. When the volume-based average particle diameter is less than 0.1 mm, the lubricant L slips between the photoconductive element 1 and the lubricating blade 7*a* without forming a thin layer. When the volume-based average particle diameter is greater than 3.0 mm, the lubricating blade 7*a* removes the lubricant L before forming a thin layer on the photoconductive element 1.

Referring again to FIG. 1, a series of image forming operations of the image forming apparatus 200 according to the present invention is described below. The description is made with references to the photoconductive element 1*a* because the structures of the photoconductive elements 1*a*, 1*b*, 1*c* and 1*d* are similar, but may be used with toners of different colors from one another.

In FIG. 1, the optical writing unit 4 emits a laser beam from a corresponding LD source. The laser beam travels through optical components and reaches the photoconductive element 1*a*. The surface of the photoconductive element 1*a* is uniformly charged with a predetermined voltage by the charging unit 3. The laser beam emitted from the optical writing unit 4 irradiates the surface of the photoconductive element 1 to form an electrostatic latent image according to image data corresponding to each toner color. The electrostatic latent image is visualized by the developing unit 5 as a toner image.

After the toner image is formed on the photoconductive element 1, the toner image is attracted by an electrostatic force exerted by the primary transfer roller 6*a*, and is transferred onto a surface of the intermediate transfer belt 10 which moves in synchronization with the photoconductive element 1. The cleaning unit 2 removes residual toner on the surface of the photoconductive element 1 for preparing a next image forming operation. After the cleaning unit 2 cleaned the surface of the photoconductive element 1, the lubricant L is supplied from the lubricant supplying unit 7 to the surface of the photoconductive element 1. The lubricant L supplied on the surface of the photoconductive element 1 is pressed between the photoconductive element 1 and the lubricant blade 7*a* to form a thin layer on the photoconductive element 1. The thin layer may be formed during the image forming operation and during the rotation of the photoconductive element 1. The thus formed thin layer is substantially thin so that a negative effect is rarely exerted to the charging for the photoconductive element 1 by the charging unit 3.

The toner developed on the surface of the photoconductive element 1 contacts the intermediate transfer belt 10. When the first transfer roller 6*a* presses the intermediate transfer belt 10, a developing bias is applied to the intermediate transfer belt 10 and the toner is transferred from the photoconductive element 1 to the intermediate transfer belt 10. Due to the thin layer formed on the surface of the photoconductive element 1, the friction coefficient is equal to or less than 0.3 at this time, and the adherence generated between the toner and the photoconductive element 1 becomes small. Accordingly, the toner can easily be separated from the photoconductive element 1 with high transferability, and the toner particle having an average circularity equal to or more than 0.93 is used to faithfully transfer the toner image to obtain an image having a high definition. In addition, since the high transferability reduces the unused toner, the strain on the cleaning blade 2*a* may be reduced and the useful life of the cleaning blade 2*a* may be extended.

The intermediate transfer belt 10 receives the toner image on its surface and moves in a direction indicated by an arrow in the figure. The photoconductive element 1*b* receives a light beam (not shown) to form an electrostatic latent image corresponding to a color of the photoconductive element 1*b* on the surface of the photoconductive element 1*b*.

The electrostatic latent image formed on the surface of the photoconductive element 1*b* is developed as a toner image. The toner image on the photoconductive element 1*b* is transferred onto the intermediate transfer belt 10 on which the toner image corresponding to the photoconductive element 1*a* is previously transferred. The toner image corresponding to the photoconductive element 1*b* is overlaid on the toner image corresponding to the photoconductive element 1*b*. The above-described operation is repeated for four times until four colors of respective toner images corresponding to the photoconductive elements 1*a*, 1*b*, 1*c* and 1*d* are overlaid to form a four color toner image.

In the image forming operations performed in the tandem type image forming apparatus, toner images are formed on the four photoconductive elements 1*a*, 1*b*, 1*c* and 1*d* while the intermediate transfer belt 10 moves to sequentially receive the toner images in one rotation of the photoconductive elements 1*a*, 1*b*, 1*c* and 1*d*, thereby reducing a time period for the image forming operations. When the intermediate transfer belt 1 reaches a predetermined point along a paper path, a transfer paper P is fed from the sheet feeding cassette 21. When the pickup roller 22 held in contact with the transfer paper P is rotated counterclockwise in FIG. 1, the transfer paper P placed on a top of a stack of transfer papers in the sheet feeding cassette 21 is fed and is conveyed to a portion between rollers of a registration roller pair 28. The registration roller pair 28 stops and feeds the transfer paper P in synchronization with a movement of the four color toner image towards a secondary transfer area, which is a secondary nip portion formed between the supporting roller 11 of the intermediate transfer belt 10 and a secondary transfer roller 110 of a conveyance belt 100. The secondary transfer roller 110 is applied with an adequate predetermined transfer voltage such that the four color toner image, formed on the surface of the intermediate transfer belt 10, is transferred on to the transfer paper P in the secondary transfer area. The four color toner image transferred on the conveyance belt 100 is referred to as a full color image.

A negative polarity is applied for the toner for forming a toner image on the photoconductive element 1. When a positive polarity is applied to the primary transfer roller 6*a*, the toner on the surface of the photoconductive element 1 is attracted by the positive polarity and is transferred onto the intermediate transfer belt 10. When the positive polarity is applied to the secondary transfer roller 110, the toner on the surface of the intermediate transfer belt 10 is transferred onto the transfer paper P. The transfer paper P having toner images on both sides thereof is conveyed to a fixing unit 30. After the transfer paper P passes the fixing unit 30, the transfer paper P is discharged by a sheet discharging roller 32 to a sheet discharging tray 40 provided at the upper portion of the image forming apparatus 200. With the structure of the image forming apparatus 200 illustrated in FIG. 1, the transfer paper P is discharged and accumulated on the sheet discharging tray 40 in a face down manner. When the image forming operation starts with a first page of a job to sequentially precede the image forming operation, a user can easily sort an accumulated papers stack on the sheet discharging tray 40. After the toner images are transferred from the surface of the intermediate transfer belt 10 onto the transfer paper P, a cleaning unit 250 including known cleaning components such as a brush roller, a collection roller, and/or the cleaning blade removes residual toner and paper dust and collects into the cleaning unit 250.

Figure 3:
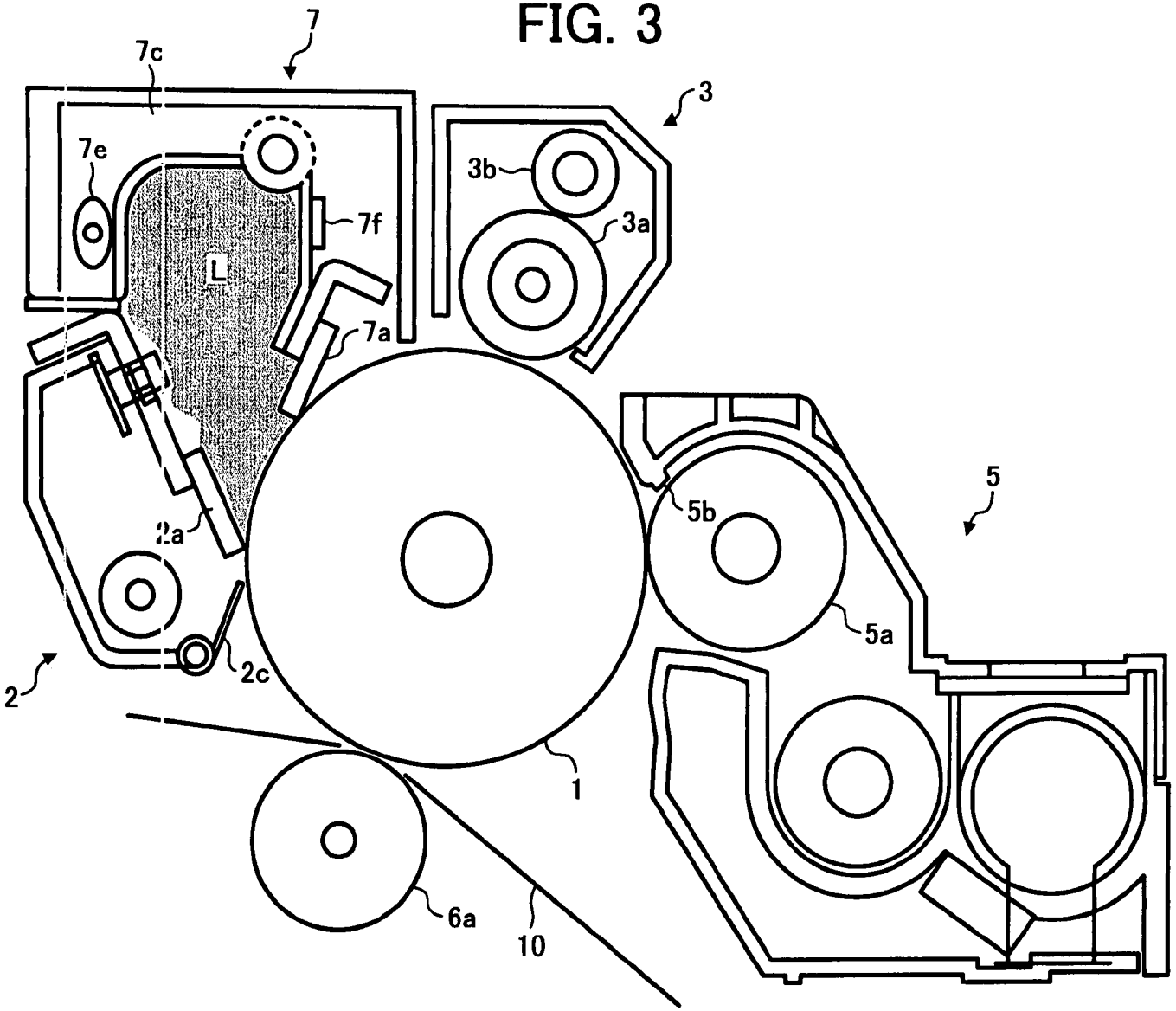
FIG. 3 is a cross sectional view of another structure of the image bearing member and the image forming components in the image forming apparatus of FIG. 1.

Referring to FIG. 3, another structure of the image forming components around the photoconductive element 1 is described. The structures of the respective image components of FIG. 3 are similar to those of FIG. 2, except for a disposition of the respective components and additional components such as a cam 7*e* and an oscillator 7*f*.

Therefore, the suffixes of the respective image forming components of FIG. 3 are the same as those of the image forming components of FIG. 2.

As shown in FIG. 3, the lubricant supplying unit 7 is disposed above a center of the photoconductive element 1 in a horizontal plane. In this structure, the lubricant supplying unit 7 is disposed in contact with the photoconductive element 1 and supplies the lubricant L by its own weight without using the lubricant supplying roller 7*b*. Thereby, the lubricant supplying unit 7 can be made in a compact size, resulting in a cost reduction. Also, a member providing a mechanical or electrical shock or vibration is provided to the lubricant supplying unit 7. The cam 7*e* is provided in the lubricant container 7*c* to rotate for providing a shock by constantly pushing a predetermined portion of an inner wall of the lubricant container 7*c*. Alternately, a solenoid may be fitted to the lubricant L to shift a magnetic core. The oscillator 7*f* is provided in the lubricant supplying unit 7 to cause vibration to the lubricant L. By causing the shock or vibration, the lubricant L may stably be applied to the photoconductive element 1 without forming a bridge and a hollow portion of the lubricant L in the lubricant supplying unit 7.

Figure 4:
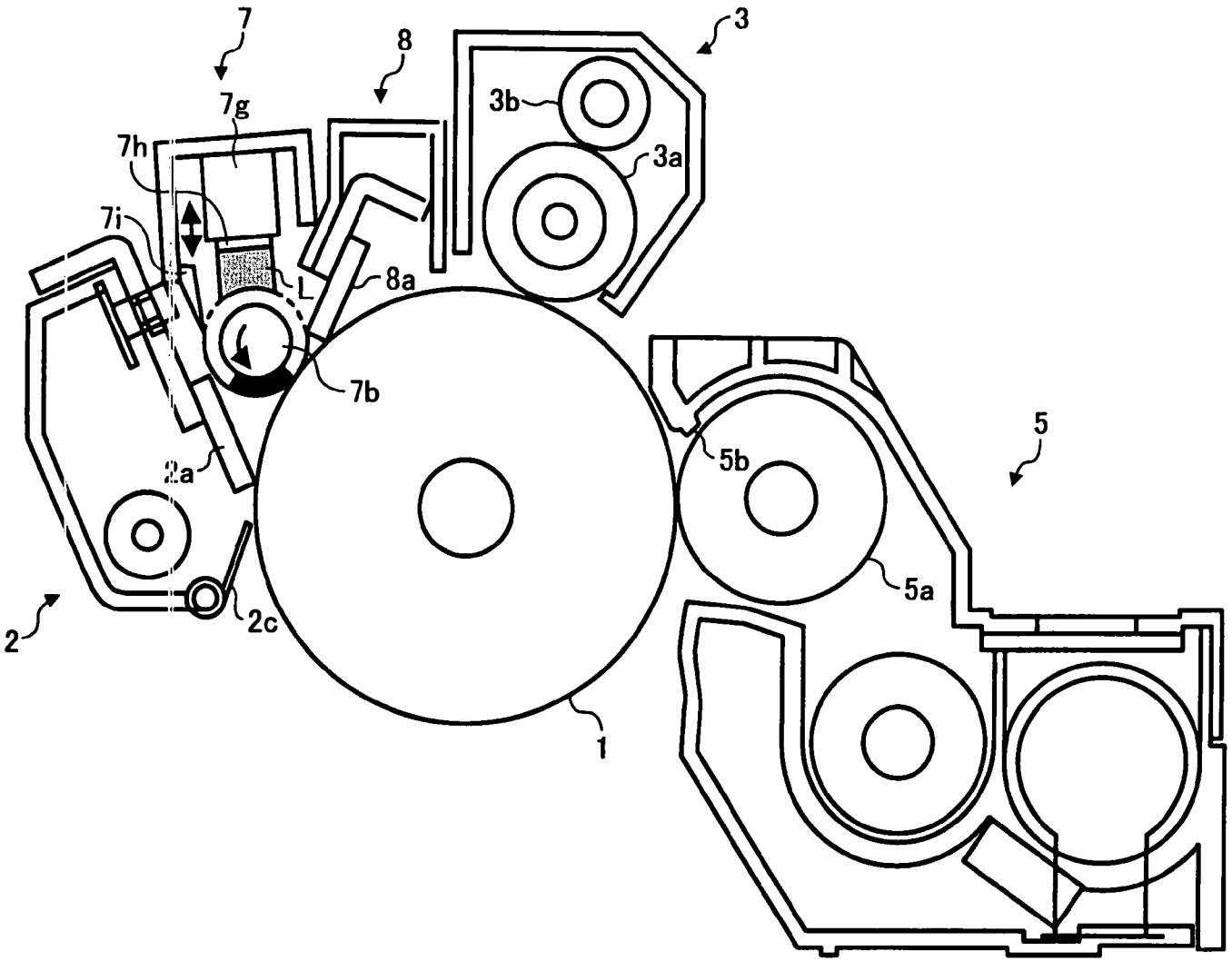
FIG. 4 is a cross sectional view of a structure of the image bearing member and the image forming components according to another embodiment of the present invention.

Referring to FIG. 4, another structure of the image forming components around the photoconductive element 1 is described. The structures of the respective image components of FIG. 4 are similar to those of FIG. 2, except for a disposition of the components and additional components such as a pressure member 7*g* and a holder 7*h*. Therefore, the suffixes of the respective image forming components of FIG. 3 are the same as those of the image forming components of FIG. 2.

As shown in FIG. 4, a second cleaning unit 8 is provided in a vicinity of or adjacent to the photoconductive element 1. The toner developed on the surface of the photoconductive element 1 is transferred onto the transfer paper P (see FIG. 1) by the transfer unit 6. Unused toner left on the surface of the photoconductive element 1 is removed by the cleaning unit 2. Hereafter, the cleaning unit 2 is referred to as a primary cleaning unit 2. The primary cleaning unit 2 includes a cleaning blade 2*a* that has a flat-shaped elastic member from the surface of the photoconductive element 1. The primary cleaning unit 2 removes substantially all the unused toner. However, it may be difficult to completely remove all the unused toner. When the cleaning blade 2*a* scrapes the unused toner, a sphere toner having a strong adhesion to the photoconductive element 1 or a small toner having a small diameter thereof may slip at the edge of the cleaning blade 2*a*. A lubricant supplying unit 7 is provided downstream of the primary cleaning unit 2. The lubricant L may be powder or may be solid. A surface of the lubricant in a solid form is scraped with a supplying brush 7*b* including a rotational brush so that the lubricant L can be applied onto the surface of the photoconductive element 1. A lubricant in solid form is fitted to the holder 7*h* by a pressure-sensitive adhesive double coated tape. The pressure member 7*g* such as a pressure spring applies a pressure onto the holder 7*h*, and the solid lubricant L is applied to the supplying roller 6*b* at a predetermined pressure.

Accordingly, the surface of the photoconductive element 1 is maintained in a low friction condition downstream of the lubricant supplying unit 7. An amount of the scraped lubricant L scraped by the supplying roller 7*b* is prevented from being too large to be supply to the surface of the photoconductive element 1. Therefore, even when the lubricant L is accumulated at a lower portion of the brush, the lubricant L is gradually coated on the surface of the photoconductive element 1. The accumulated lubricant L is mixed with a small amount of toner leaked from the primary cleaning unit 2. However, such a small amount of toner does not affect a lubricant efficiency. A secondary cleaning unit 8 is provided downstream of the lubricant supplying unit 7. The secondary cleaning unit 8 includes a flat-shaped elastic cleaning blade 8*a*, and contacts the surface of the photoconductive element 1 in a direction opposite to a rotating direction of the photoconductive element 1. The direction opposite to the rotating direction of the photoconductive element 1 is referred to as a counter direction. The cleaning blade 8*a* in the counter direction abuts the photoconductive element 1 facilitates removal of the toner remaining on the surface of the photoconductive element 1. When a friction coefficient generated between the photoconductive element 1 and the cleaning blade 8*a* increases, the cleaning blade 8*a* curls in a different direction.

Figure 5:
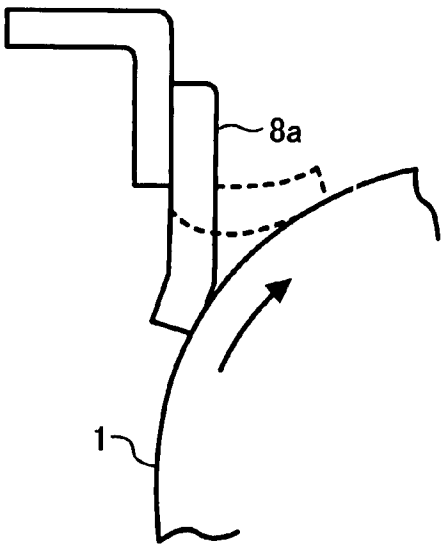
FIG. 5 is a detail view showing a cleaning blade in contact with the image bearing member.

FIG. 5 shows that the cleaning blade 8*a* contacting the photoconductive element 1 is curled. The unused toner decreases a frictional coefficient. Since the unused toner is sufficiently collected, the primary cleaning unit 2 is maintained in a counter direction. Conversely, while the second cleaning unit 8 collects a small amount of the unused toner which is leaked out of the primary cleaning unit 2, the collected amount is not sufficient to prevent the curling.

However, the contact position with the photoconductive element 1 is at a portion in the low friction condition downstream of the lubricant supplying portion. Therefore, the inversion does not occur. Thus, regardless of the amount of toner leaked from the primary cleaning unit 2, the unused toner can be effectively removed. Preferably, a contact angle of the secondary cleaning unit 8 with respect to the photoconductive element 1 is less than that of the primary cleaning unit 2. The large contact pressure increases wear of the photoconductive element 1, causing a shortening of a life of the photoconductive element. It is because when an amount of the contact pressure is large, the surface of the photoconductive element 1 has more wearing, which leads to a short life of the photoconductive element 1. When an amount of the contact pressure is small, toner removability decreases. However, the lubricant supplying unit 7 is disposed upstream of the second cleaning unit 8. Therefore, the surface of the photoconductive element 1 is in the low friction condition. That is, the toner can be removed with less force. Therefore, the toner can be removed with a smaller contact pressure.

The lubricant L may be in a molded solid form or a powder form. Preferably, the lubricant L is in a powder form so that the thin layer can uniformly be formed.

By applying the lubricant L to the surface of the photoconductive element 1, the thin layer of the lubricant L can be formed on the surface of the photoconductive drum 1, and have a friction coefficient of equal to or less than 0.3. Preferably, the friction coefficient of the photoconductive element 1 is equal to or less than 0.3, and more preferably is equal to or less than 0.2. By setting the friction coefficient equal to or less than 0.3, an interaction between the photoconductive element 1 and the toner can be reduced, so that the toner remaining on the photoconductive element 1 can easily be released to increase transferability. In addition, friction between the cleaning blade 2*a* and the photoconductive element 1 can be controlled to increase cleaning efficiency. In particularly, the toner having a high circularity is easily removed from the photoconductive element 1 so that a cleaning failure can be prevented. In addition, by increasing a transferability to reduce an amount of toner to be cleaned, the cleaning failure due to long-term usage of toner may be prevented. More preferably, the coefficient of friction of the toner is equal to or less than 0.2. Conversely, when the friction coefficient is below 0.1, the toner can easily slip between the cleaning blade 2*a* and the photoconductive element 1, and the cleaning failure may occur such that the toner on the cleaning blade 2 passes by the cleaning blade 2*a* to the photoconductive element 1. Further, regardless of the amount of toner leaking from the primary cleaning unit 2, the secondary cleaning unit 8 applies a low pressure to reduce an amount of wearing on the surface of the photoconductive element 1 so that the unused toner can be effectively removed.

The coefficient of static friction of the photosensitive drum 1 can be measured by Euler's method as described below.

Figure 6:
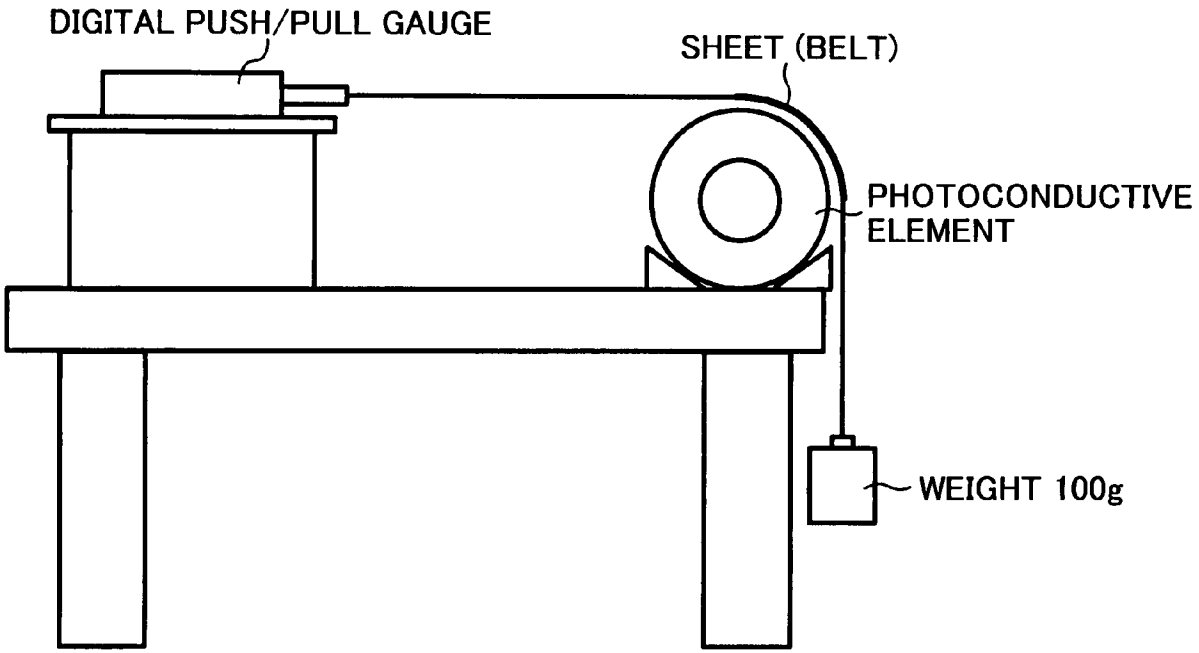
FIG. 6 is a side elevation view showing measurement of a friction coefficient of the image bearing member.

FIG. 6 is a side elevation view showing measurement of the coefficient of static friction of the photoconductive element. In this case, a good quality paper of medium thickness is stretched as a belt over one fourth of a circumference of the photoconductive element 1 longitudinally in the direction of pulling. Both ends in a pulling direction of the good quality paper is provided with strings as a member supporting the paper. A weight of 0.98 N (100 gram) is suspended from one side of the belt. A force gauge installed on the other end is pulled. And, a load when the belt is moved is read out to be substituted in a following relation: $\mu s=2/\pi\times 1n\ (F/0.98)$, where "μs" is a coefficient of static friction, and where "F" is a measured value. The friction coefficient of the photoconductive element 1 of the image forming apparatus 200 is set to a value that is set when the rotation becomes stable due to the image forming. Since the friction coefficient of the photoconductive element 1 is affected by other units disposed in the image forming apparatus 200, the value depends on a friction coefficient obtained immediately after the image forming is completed. However, the value of the friction coefficient may substantially become stable after 1000 of A4-size recording sheets are printed. Therefore, a friction coefficient described here is determined to be a friction coefficient obtained in a stable condition.

A charging unit 3 including a charging roller 3*a* as a charging member is provided at a portion downstream of the secondary cleaning unit 8.

Figure 7:
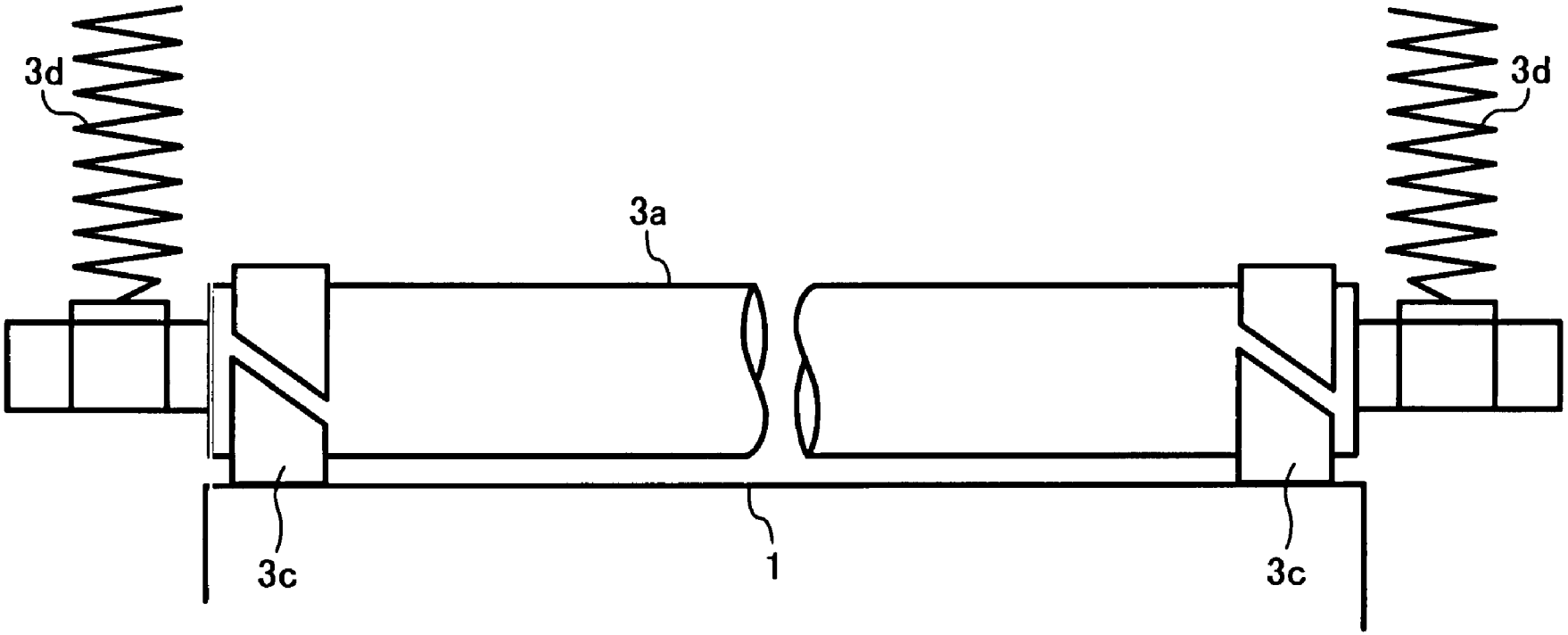
FIG. 7 is a schematic structure of a charging roller provided in the image forming apparatus of FIG. 1.

Referring to FIG. 7, a schematic structure of the charging roller 3*a* is described. The charging roller 3*a* includes a gap supporting member 3*c* at an end thereof with respect to the photoconductive element 1, so that the surface of the charging roller 3*a* can be disposed a predetermined distance from the photoconductive element 1. The thickness of the gap supporting member is from approximately 10 μm to approximately 300 μm, and determined according to a relationship of the applied voltage. The gap supporting member 3*c* is held in contact with the photoconductive element 1 by a spring 3*d* using a pressure. A predetermined voltage is applied from a power supply (not shown). The voltage includes a direct current superimposed by an alternate current. As described above, since the charging roller 3*a* does not contact the photoconductive element 1, the lubricant L coated over the surface of the photoconductive element 1 does not adhere on the charging roller 3*a*, and therefore does not accumulate thereon. Here, the charging roller 3*a* is described. However, as an alternative, a charging unit with a charger method may be employed.

The toner used here may include a volume-based average particle diameter equal to or less than 10 μm. When the volume-based average particle diameter exceeds 10 μm, it becomes difficult to produce a high-definition image. Further, the volume-based average particle diameter equal to or less than 8 μm is preferably used, such that a high-definition image can be produced. When the volume-based average particle is less than 3 μm, it may be difficult to perform cleaning by the primary cleaning blade 2*a* even if the lubricant L is supplied to form a thin layer on the surface of the photoconductive element 1 and the friction coefficient of the photoconductive element 1 becomes equal to or less than 0.3. Further, a dispersion indicated by a ratio of a volume-based average particle diameter and a number-based average particle diameter can be from approximately 1.00 to approximately 1.40. When the dispersion exceeds 1.40, a charging distribution of the toner becomes wide. Therefore, dust of the toner accumulating between thin lines of the toner image and fog appearing over the background image increase, resulting in deterioration in image quality. Further, the toner slipping by the cleaning blade 2*a* increases and enters into a portion between the lubricating blade 7*a* and the photoconductive element 1, thereby causing nonuniformity over the thin layer formed on the surface of the photoconductive element 1.

Preferably, the toner particle has an average circularity of from approximately 0.93 to approximately 1.00. The circularity of a dry toner manufactured by a dry pulverization method is thermally or mechanically controlled to be within the above-mentioned range. For example, a thermal method in which dry toner particles are sprayed with an atomizer together with hot air can be used for preparing a toner having a spherical form. That is a thermal process of ensphering the toner particle. Alternatively, a mechanical method in which a spherical toner can be prepared by agitating, dry toner particles in a mixer such as a ball mill, with a medium such as a glass having a low specific gravity can be used. However, aggregated toner particles having a large particle diameter are formed by the thermal method or fine powders are produced by the mechanical method. Therefore, the residual toner particles may be subjected to a classifying treatment. When a toner is produced in an aqueous medium, the shape of the toner can be controlled by controlling the degree of agitation in the solvent removing step.

The circularity is defined by the following equation 1:

Circularity $SR$=(circumference of circle identical in area with the projected grain image of the particle/circumference of projected grain image) Equation 1.

As the shape of a toner particle is close to a truly spherical shape, the value of circularity becomes close to 1. The toner having a high circularity is easily influenced by a line electric force when the toner is present on a carrier or a developing sleeve used for an electrostatic developing method, and an electrostatic latent image formed on the surface of the photoconductive element 1 is faithfully developed by the toner along the line of electric force thereof.

When small dots in an electrostatic latent image are developed, such spherical toner particles are adhered to the latent dot image while being uniformly and densely dispersed. Therefore, a toner image having a good thin line reproducibility can be produced without causing toner scattering. When the toner has a circularity less than 0.93, the image quality, particularly in thin line reproducibility deteriorates, thereby causing difficulty in producing high-definition images.

Preferably, a shape factor "SF1" of the toner is from approximately 100 to approximately 180, and the shape factor "SF2" of the toner is from approximately 100 to approximately 180.

The shape factor "SF1" of a particle is calculated by a following Equation 2:

$$SF1=\{(MXLNG)^2/AREA\}\times(100\pi/4) \quad \text{Equation 2,}$$

where "MXLNG" represents the maximum major axis of an elliptical-shaped figure obtained by projecting a toner particle on a two dimensional plane, and "AREA" represents the projected area of elliptical-shaped figure.

When the value of the shape factor "SF1" is 100, the particle has a perfect spherical shape. As the value of the "SF1" increases, the shape of the particle becomes more elliptical.

The shape factor "SF2" is a value representing irregularity (i.e., a ratio of convex and concave portions) of the shape of the toner. The shape factor "SF2" of a particle is calculated by a following Equation 3:

$$SF2=\{(PERI)^2/AREA\}\times(100\pi/4) \quad \text{Equation 3,}$$

where "PERI" represents the perimeter of a figure obtained by projecting a toner particle on a two dimensional plane.

When the value of the shape factor "SF2" is 100, the surface of the toner is even (i.e., no convex and concave portions). As the value of the "SF2" increases, the surface of the toner becomes uneven (i.e., the number of convex and concave portions increase).

In this embodiment, toner images are sampled by using a field emission type scanning electron microscope (FE-SEM) S-800 manufactured by Hibachi, Ltd. The toner image information is analyzed by using an image analyzer (LUSEX3) manufactured by Nireko, Ltd.

Furthermore, as the shape factors SF-1 and SF-2 increase, the toner includes irregular shapes with convexity and concavity. Also, the toner nonuniformly receives air resistance when it is moving and scattering over the image, it is difficult to move according to the electric field in a developing process and a transferring process, thereby deteriorating the image quality.

Figure 8A:
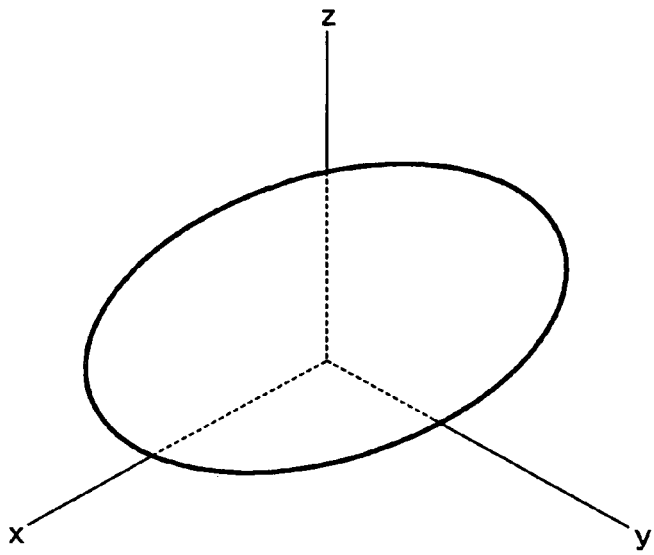
FIG. 8A is an outer shape of a toner used in the image forming apparatus of FIG. 1, FIGS. 8B and 8C are schematic cross sectional views of the toner, showing major and minor axes and a thickness of FIG. 8A.
Figure 8B:
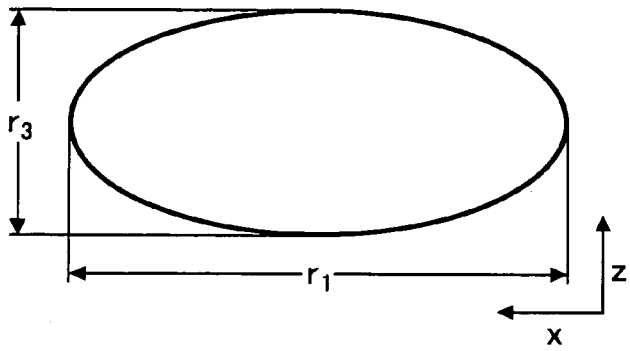
Figure 8C:
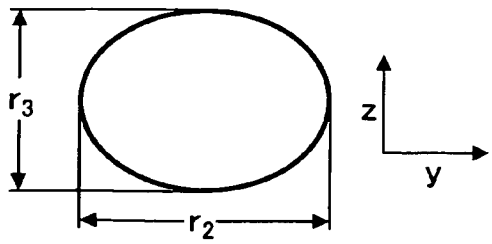

Further, the toner used in the image forming apparatus 200 may be substantially spherical. FIG. 8 shows sizes of the toner. An axis x of FIG. 8(*a*) represents a major axis r1 of FIG. 8(*b*), which is the longest axis of the toner. An axis y of FIG. 8(*a*) represents a minor axis r2 of FIG. 8(*b*), which is the second longest axis of the toner. The axis z of FIG. 8(*a*) represents a thickness r3 of FIG. 8(*b*), which is a thickness of the shortest axis of the toner. The toner has a relationship between the major and minor axes r1 and r2 and the thickness r3 as follows:

$$r1 \geqq r2 \geqq r3.$$

The toner of FIG. 8(*a*) is preferably in a spindle shape in which the ratio (r2/r1) of the major axis r1 to the minor axis r2 is from approximately 0.5 to approximately 1.0, and the ratio (r3/r2) of the thickness r3 to the minor axis is from approximately 0.7 to approximately 1.0. The lengths showing with r1, r2, and r3 can be monitored and measured with scanning electron microscope (SEM) by taking pictures from different angles.

When the ratio (r2/r1) is less than approximately 0.5, and when the ratio (r3/r2) is less than approximately 0.7, the toner has an irregular particle shape. Accordingly, the toner cannot uniformly contact the magnetic carrier, the value of the toner charge distribution increases, and the amount of toner dust increases. Thereby, image quality deteriorates.

Figure 9:
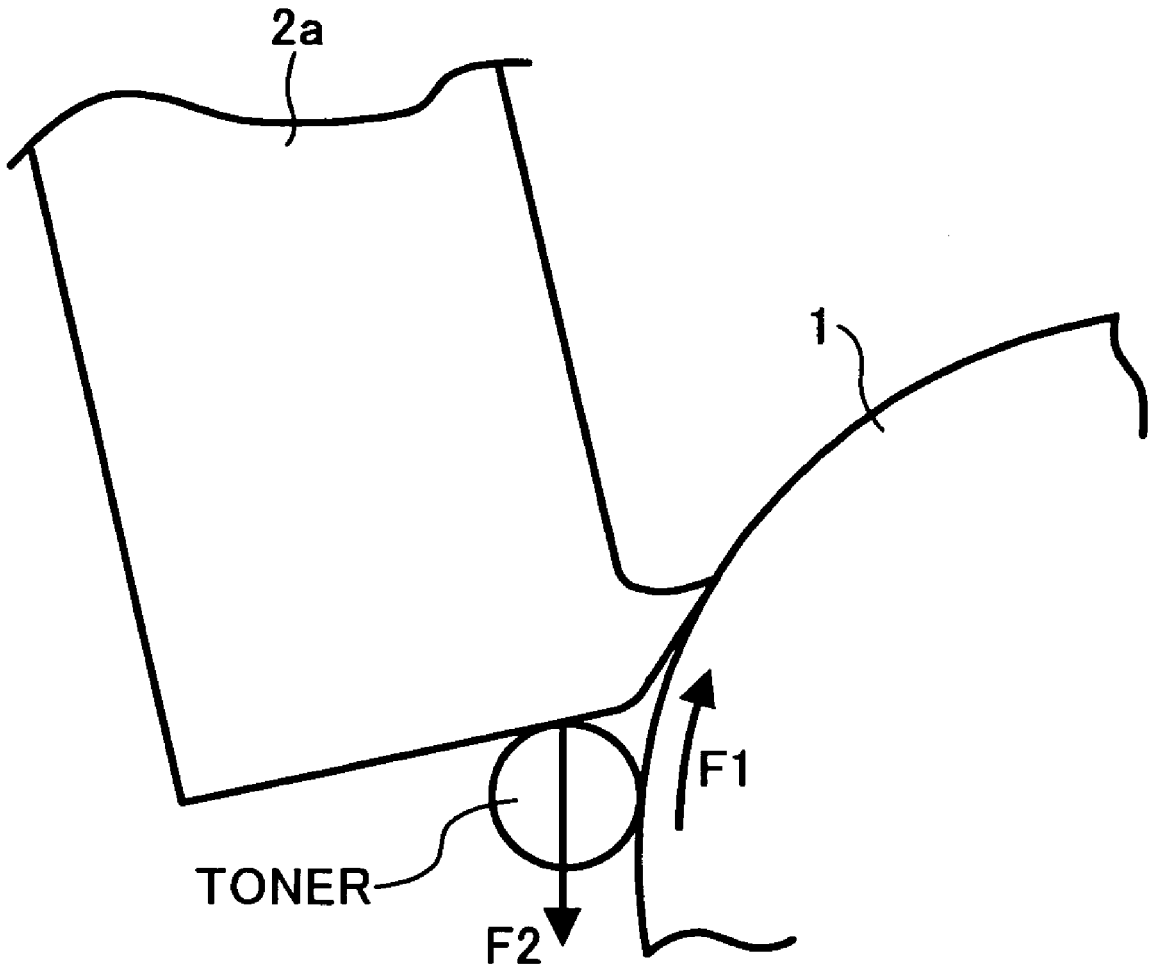
FIG. 9 is a detail view showing a relationship of force exerted on the toner at a point between a cleaning blade and the image bearing member.

Referring to FIG. 9, a relationship between the cleaning blade 2*a* and the photoconductive element 1 is described, focusing on a force exerted on the toner at the edge of the cleaning blade 2*a*.

In the image forming apparatus 200 of the present invention, a thin layer of the lubricant L uniformly is formed on the surface of the photoconductive element 1. The thin layer makes a cleaning of the surface of the photoconductive element 1 by the cleaning blade 2*a* easy. This is because the friction coefficient generated between the toner and the photoconductive element 1 is small, and a relationship is described as F2>F1, where F1 represents a force exerted to pass by the cleaning blades 2*a* and 8*a*, and F2 represents a force exerted to block the toner. Further, the first cleaning 2 and the second cleaning unit 8 are arranged, such that when the toner passes by the first cleaning unit 2, it is blocked by the second cleaning unit 8. Therefore, a toner particle having an average diameter equal to or less than 10 μm and a polymerized toner manufactured with a polymerization method can be removed.

The image forming apparatus 200 of this embodiment includes two cleaning units. As an alternative, three or more cleaning units may be provided in the image forming apparatus 200. In addition, the first cleaning unit 2 and the cleaning blade 2*a* may include a brush, instead of the flat-shaped elastic member. The brush may be applied with a predetermined voltage to electrostatically remove the toner. Preferably, when the brush is employed, a flicker member 7*i* is used for flicking the toner remaining on the brush. The lubricant supplying method is not limited as shown in FIG. 4. The lubricant L may have a powder form or a cylindrical shape to be supplied in direct contact with the photoconductive element 1.

A toner having a substantially spherical shape is preferably prepared by a method in which a toner composition including a polyester prepolymer having a function group including a nitrogen atom, a polyester, a colorant, and a releasing agent in subjected to an elongation reaction and/or a crosslinking reaction in an aqueous medium in the presence of fine resin particles. Since thus prepared toner has a hardened surface, the toner has a good hot offset resistance.

Therefore, the toner hardly causes a problem in that toner particles adhere to the fixing unit 30, which would resulting in degradation in the resultant copy image.

Toner constituents and preferable manufacturing method of the toner of the prevent invention will be described below.

(Polyester)

Polyester is produced by the condensation polymerization reaction of a polyhydric alcohol compound with a polyhydric carboxylic acid compound.

As the polyhydric alcohol compound (PO), dihydric alcohol (DIO) and polyhydric alcohol (TO) higher than trihydric alcohol can be used. In particular, a dihydric alcohol DIO alone or a mixture of a dihydric alcohol DIO with a small amount of polyhydric alcohol (TO) is preferably used. Specific examples of the dihydric alcohol (DIO) include alkylene glycol such as ethylene glycol, 1,2-propylene glycol, 1,3-propylene glycol, 1,4-butanediol, 1,6-hexanediol; alkylene ether glycol such as diethylene glycol, triethylene glycol, dipropylene glycol, polyethylene glycol, polypropylene glycol, polytetramethylene ether glycol; alicyclic diol such as 1,4-cyclohexane dimethanol, hydrogenated bisphenol A; bisphenols such as bisphenol A, bisphenol F, bisphenol S; adducts of the above-mentioned alicyclic diol with an alkylene oxide such as ethylene oxide, propylene oxide, butylenes oxide; adducts of the above-mentioned bisphenol with an alkylene oxide such as ethylene oxide, propylene oxide, butylenes oxide. In particular, alkylene glycol having 2 to 12 carbon atoms and adducts of bisphenol with an alkylene oxide are preferably used, and a mixture thereof is more preferably used. Specific examples of the polyhydric alcohol (TO) higher than trihydric alcohol include multivalent aliphatic alcohol having tri-octa hydric or higher hydric alcohol such as glycerin, trimethylolethane, trimethylolpropane, pentaerythritol and sorbitol; phenol having tri-octa hydric or higher hydric alcohol such as trisphenol PA, phenolnovolak, cresolnovolak; and adducts of the above-mentioned polyphenol having tri-octa hydric or higher hydric alcohol with an alkylene oxide.

As the polycarboxylic acid (PC), dicarboxylic acid (DIC) and polycarboxylic acids having 3 or more valences (TC) can be used. A dicarboylic acid (DIC) alone, or a mixture of the dicarboxylic acid (DIC) and a small amount of polycarboxylic acid having 3 or more valences (TC) is preferably used. Specific examples of the dicarboxylic acids (DIC) include alkylene dicarboxylic acids such as succinic acid, adipic acid and sebacic acid; alkenylene dicarboxylic acid such as maleic acid and fumaric acid; and aromatic dicarboxylic acids such as phthalic acid, isophthalic acid, terephthalic acid and naphthalene dicarboxylic acid. In particular, alkenylene dicarboxylic acid having 4 to 20 carbon atoms and aromatic dicarboxylic acid having 8 to 20 carbon atoms are preferably used. Specific examples of the polycarboxylic acid having 3 or more valences (TC) include aromatic polycarboxylic acids having 9 to 20 carbon atoms such as trimellitic acid and pyromellitic acid. The polycarboxylic acid (PC) can be formed from a reaction between the above-mentioned acids anhydride or lower alkyl ester such as methyl ester, ethyl ester and isopropyl ester.

The polyhydric alcohol (PO) and the polycarboxylic acid (PC) are mixed such that the equivalent ratio ([OH]/[COOH]) between the hydroxyl group [OH] of the poly hydric alcohol (PO) and the carboxylic group [COOH] of the polycarboxylic acid (PC) is typically from 2/1 to 1/1, preferably from 1.5/1 to 1/1 and more preferably from 1.3/1 to 1.02/1.

In the condensation polymerization reaction of a polyhydric alcohol (PO) with a polyhydric carboxylic acid (PC), the polyhydric alcohol (PO) and the polyhydric carboxylic acid (PC) are heated to a temperature from 150° C. to 280° C. in the presence of a known esterification catalyst, e.g., tetrabutoxy titanate or dibutyltineoxide. The generated water is distilled off with pressure being lowered, if necessary, to obtain polyester resin containing a hydroxyl group. The hydroxyl value of the polyester resin is preferably 5 or more while the acid value of polyester is usually between 1 and 30, preferably between 5 and 20. When a polyester resin having such an acid value is used, the residual toner is easily negatively charged. In addition, the affinity of the toner for recording paper can be improved, resulting in improvement of low temperature fixability of the toner. However, a polyester resin with an acid value above 30 can adversely affects stable charging of he residual toner, particularly when the environmental conditions vary.

A weight-mean molecular weight of the polyester resin is from 10,000 to 400,000, preferably, and more preferably from 20,000 to 200,000. A polyester resin with a weight-average molecular weight between 10,000 lowers the offset resistance of the residual toner while a polyester resin with a weight-average molecular weight above 400,000 lowers the temperature fixability.

A urea-modified polyester is preferably included in the toner in addition to unmodified polyester produced by the above-described condensation polymerization reaction. The urea-modified polyester is produced by reacting the carboxylic group or hydroxyl group at the terminal of a polyester obtained by the above-described condensation polymerization reaction with a polyisocyanate compound (PIC) to obtain polyester prepolymer (A) having an isocyanate group, and then reacting the prepolymer (A) with amines to crosslink and/or extend the molecular chain.

Specific examples of the polyvalent isocyanate compound (PIC) include aliphatic polyvalent isocyanate such as tetra methylenediisocyanate, hexamethylenediisocyanate, 2,6-diisocyanate methyl caproate; alicyclic polyisocyanate such as isophoronediisocyanate, cyclohexylmethane diisocyanate; aromatic diisocyanate such as tolylenediisocyanate, diphenylmethene diisocyanate; aroma-aliphatic diisocyanate such as $\alpha,\alpha,\alpha',\alpha'$,-tetramethylxylene diisocynate; isocaynates; the above-mentioned isocyanats blocked with phenol derivatives, oxime, caprolactam; and a combination of two or more of them.

The polyvalent isocyanate compound (PIC) is mixed such that the equivalent ratio ([NCO]/[OH]) between an isocyanate group [NCO] and a hydroxyl group [OH] of polyester having the isocyanate group and the hydroxyl group is typically from 5/1 to 1/1, preferably from 4/1 to 1.2/1, and more preferably from 2.5/1 to 1.5/1. A ratio of [NCO]/[OH] higher than 5 can deteriorate low-temperature fixability. As for a molar ratio of [NCO] below 1, if the urea-modified polyester is used, then the urea content in the ester is low, lowering the hot offset resistance.

The content of the constitutional unit obtained from a polyisocyanate (PIC) in the polyester prepolymer (A) is from 0.5% to 40% by weight, preferably from 1 to 30% by weight and more preferably from 2% to 20% by weight. When the content is less than 0.5% by weight, hot offset resistance of the resultant toner deteriorates and in addition the heat resistance and low temperature fixability of the toner also deteriorate. In contrast, when the content is greater than 40% by weight, low temperature fixability of the resultant toner deteriorates.

The number of the isocyanate groups included in a molecule of the polyester prepolymer (A) is at least 1, preferably from 1.5 to 3 on average, and more preferably from 1.8 to 2.5 on average. When the number of the isocyanate group is less than 1 per 1 molecule, the molecular weight of the urea-modified polyester decreases and hot offset resistance of the resultant toner deteriorates.

Specific examples of the amines (B) include diamines (B1), polyamines (B2) having three or more amino groups, amino alcohols (B3), amino mercaptans (B4), amino acids (B5) and blocked amines (B6) in which the amines (B1–B5) mentioned above are blocked.

Specific examples of the diamines (B1) include aromatic diamines (e.g., phenylene diamine, diethyltoluene diamine and 4,4'-diaminodiphenyl methane); alicyclic diamines (e.g., 4,4'-diamino-3,3'-dimethyldicyclohexyl methane, diamino cyclohexane and isophoron diamine); aliphatic diamines (e.g., ethylene diamine, tetramethylene diamine and hexamethylene diamine); etc. Specific examples of the polyamines (B2) having three or more amino groups include diethylene triamine, triethylene tetramine. Specific examples of the amino alcohols (B3) include ethanol amine and hydroxyethyl aniline. Specific examples of the amino mercaptan (B4) include aminoethyl mercaptan and aminopropyl mercaptan. Specific examples of the amino acids include amino propionic acid and amino caproic acid. Specific examples of the blocked amines (B6) include ketimine compounds which are prepared by reacting one of the amines B1–B5 mentioned above with a ketone such as acetone, methyl ethyl ketone and methyl isobutyl ketone; oxazoline compounds, etc. Among these compounds, diamines (B1) and mixtures in which a diamine is mixed with a small amount of a polyamine (B2) are preferably used.

The mixing ratio (i.e., a ratio [NCO]/[NHx]) of the content of the prepolymer (A) having an isocyanate group to the amine (B) is from 1/2 to 2/1, preferably from 1.5/1 to 1/1.5 and more preferably from 1.2/1 to 1/1.2. When the mixing ratio is greater than 2 or less than 1/2, molecular weight of the urea-modified polyester decreases, resulting in deterioration of hot offset resistance of the resultant toner.

Suitable polyester resins for use in the toner of the present invention may include a urea-modified polyesters. The urea-modified polyester may include a urethane bonding as well as a urea bonding. The molar ratio (urea/urethane) of the urea bonding to the urethane bonding is from 100/0 to 10/90, preferably from 80/20 to 20/80 and more preferably from 60/40 to 30/70. When the molar ratio of the urea bonding is less than 10%, hot offset resistance of the resultant toner deteriorates.

The urea modified polyester is produced by, for example, a one-shot method. Specifically, a polyhydric alcohol (PO) and a polyhydric carboxylic acid (PC) are heated to a temperature of from 150° C. to 280° C. in the presence of the known esterification catalyst, e.g., tetrabutoxy titanate or dibutyltineoxide to be reacted. The resulting water is distilled off with pressure being lowered, if necessary, to obtain a polyester containing a hydroxyl group. Then, a polyisocyanate (PIC) is reacted with the polyester obtained above a temperature of from 40° to 140° C. to prepare a polyester prepolymer (A) having a isocyanate group. The prepolymer (A) is further reacted with an amine (B) at a temperature of from 0° C. to 140° C. to obtain a urea-modified polyester.

At the time of reacting the polyisocyanate (PIC) with a polyester and reacting the polyester prepolymer (A) with the amines (B), a solvent may be used. Specific examples of the solvent include solvents inactive to the isocyanate (PIC), e.g., aromatic solvents such as toluene, xylene; ketones such as acetone, methyl ethyl ketone, methyl isobutyl ketone; esters such as ethyl acetate; amides such as dimethyl formamide, dimethyl acetatamide; and ethers such as tetrahydrofuran.

If necessary, a reaction terminator may be used for the cross-linking reaction and/or extension reaction of polyester prepolymer (A) with an amine (B), to control the molecular weight of the obtained urea-modified polyester. Specific examples of the reaction terminating agents include a monoamine such as diethylamine, dibutylamine, butylamine, lauryl amine, and blocked substances thereof such as a ketimine compound.

The weight-average molecular weight of the urea-modified polyester is not less than 10,000, preferably from 20,000 to 10,000,000 and more preferably from 30,000 to 1,000,000. A molecular weight of less than 10,000 deteriorates the hot offset resisting property. The number-average molecular weight of the urea-modified polyester is not particularly limited when the after-mentioned unmodified polyester resin is used in combination. Namely, the weight-average molecular weight of the urea-modified polyester resins has priority over the number-average molecular weight thereof. However, when the urea-modified polyester is used alone, the number-average molecular weight is not greater than 20,000, preferably from 1,000 to 10,000, and more preferably from 2,000 to 8,000. When the number-average molecular weight is greater than 20,000, the low temperature fixability of the resultant toner deteriorates, and in addition the glossiness of full color images deteriorates.

In the present invention, not only the urea-modified polyester alone but also the unmodified polyester resin can be included with the urea-modified polyester. A combination thereof improves low temperature fixability of the resultant toner and glossiness of color images produced by the full-color image forming apparatus 200, and using the combination is more preferable than using the urea-modified polyester alone. It is noted that the unmodified polyester may contain polyester modified by a chemical bond other than the urea bond.

It is preferable that the urea-modified polyester at least partially mixes with the unmodified polyester resin to improve the low temperature fixability and hot offset resistance of the resultant toner. Therefore, the urea-modified polyester preferably has a structure similar to that of the unmodified polyester resin.

A mixing ratio between the urea-modified polyester and polyester resin is from 20/80 to 5/95 by weight, preferably from 70/30 to 95/5 by weight, more preferably from 75/25 to 95/5 by weight, and even more preferably from 80/20 to 93/7 by weight. When the weight ratio of the urea-modified polyester is less than 5%, the hot offset resistance deteriorates, and in addition, it is difficult to impart a good combination of high temperature preservability and low temperature fixability of the toner.

The toner binder preferably has a glass transition temperature (Tg) of from 45° C. to 65° C., and preferably from 45 C° to 60° C. When the glass transition temperature is less than 45° C., the high temperature preservability of the toner deteriorates. When the glass transition temperature is higher than 65° C., the low temperature fixability deteriorates.

Since the urea-modified polyester can exist on the surfaces of the mother toner particles, the toner of the present invention has better high temperature preservability than conventional toners including a polyester resin as a binder resin even though the glass transition temperature is low.

A colorant, a charge control agent, and a releasing agent can be selected from existing materials.

The method for manufacturing the toner is described.

The toner of the present invention is produced by the following method, but the manufacturing method is not limited thereto.

(Preparation of Toner)

First, a colorant, unmodified polyester, polyester prepolymer having isocyanate groups and a parting agent are dispersed into an organic solvent to prepare a toner material liquid.

The organic solvent should preferably be volatile and have a boiling point of 100° C. or below because such a solvent is easy to remove after the formation of the toner mother particles. More specific examples of the organic solvent includes one or more of toluene, xylene, benzene, carbon tetrachloride, methylene chloride, 1,2-dichloroethane, 1,1,2-trichloroethane, trichloro ethylene, chloroform, monochlorobenzene, dichloroethylidene, methyl acetate, ethyl acetate, methyl ethyl ketone, methyl isobutyl ketone, and so forth. Particularly, the aromatic solvent such as toluene and xylene; and a hydrocarbon halide such as methylene chloride, 1,2-dichloroethane, chloroform or carbon tetrachloride is preferably used. Preferably, the amount of the organic solvent to be used is from 0 parts by weight to 300 parts by weight for 100 parts by weight of polyester prepolymer, more preferably from 0 parts by weight to 100 parts by weight for 100 parts by weight of polyester prepolymer, and even more preferably from 25 parts by weight to 70 parts by weight for 100 parts by weight of polyester prepolymer.

The toner material liquid is emulsified in an aqueous medium in the presence of a surfactant and organic fine particles.

The aqueous medium for use in the present invention is water alone or a mixture of water with a solvent which can be mixed with water. Specific examples of such a solvent include alcohols (e.g., methanol, isopropyl alcohol and ethylene glycol), dimethylformamide, tetrahydrofuran, cellosolves (e.g., methyl cellosolve), lower ketones (e.g., acetone and methyl ethyl ketone), etc.

The content of the aqueous medium is typically from 50 to 2,000 parts by weight, and preferably from 100 to 1,000 parts by weight, per 100 parts by weight of the toner constituents. When the content is less than 50 parts by weight, the dispersion of the toner constituents in the aqueous medium is not satisfactory, and thereby the resultant mother toner particles do not have a desired particle diameter. In contrast, when the content is greater than 2,000, the manufacturing costs increase.

Various dispersants are used to emulsify and disperse an oil phase in an aqueous liquid including water in which the toner constituents are dispersed. Specific examples of such dispersants include surfactants, resin fine-particle dispersants, etc.

Specific examples of the dispersants include anionic surfactants such as alkylbenzenesulfonic acid salts, .alpha.-olefin sulfonic acid salts, and phosphoric acid salts; cationic surfactants such as amine salts (e.g., alkyl amine salts, aminoalcohol fatty acid derivatives, polyamine fatty acid derivatives and imidazoline), and quaternary ammonium salts (e.g., alkyltrimethylammonium salts, dialkyldimethylammonium salts, alkyldimethyl benzyl ammonium salts, pyridinium salts, alkyl isoquinolinium salts and benzethonium chloride); nonionic surfactants such as fatty acid amide derivatives, polyhydric alcohol derivatives; and ampholytic surfactants such as alanine, dodecyldi(aminoethyl)glycine, di(octylaminoethyle)glycine, and N-alkyl-N,N-dimethylammonium betaine.

A surfactant having a fluoroalkyl group can prepare a dispersion having good dispersibility even when a small amount of the surfactant is used. Specific examples of anionic surfactants having a fluoroalkyl group include fluoroalkyl carboxylic acids having from 2 to 10 carbon atoms and their metal salts, disodium perfluorooctanesulfonylglutamate, sodium 3-{omega-fluoroalkyl(C6–C11)oxy}-1-alkyl (C3–C4)sulfonate, sodium, 3-lomega-fluoroalkanoyl (C6–C8)-N-ethylamino}-1-propanesulfonate, fluoroalkyl (C11–C20)carboxylic acids and their metal salts, perfluoroalkylcarboxylic acids and their metal salts, perfluoroalkyl(C4–C12)sulfonate and their metal salts, perfluorooctanesulfonic acid diethanol amides, N-propyl-N-(2-hydroxyethyl-)perfluorooctanesulfone amide, perfluoroalkyl (C6–C10)sulfoneamidepropyltrimethylammonium salts, salts of perfluoroalkyl(C6–C10)-N-ethylsulfonylglycin, monoperfluoroalkyl(C6–C16)ethylphosphates, etc.

Specific examples of the marketed products of such surfactants having a fluoroalkyl group include SARFRON® S-111, S-112 and S-113, which are manufactured by Asahi Glass Co., Ltd.; FLUORAD® FC-93, FC-95, FC-98 and FC-129, which are manufactured by Sumitomo 3M Ltd.; UNDYNE® DS-101 and DS-102, which are manufactured by Daikin Industries, Ltd.; MEGAFACE® F-110, F-120, F-113, F-191, F-812 and F-833 which are manufactured by Dainipponink and Chemicals, Inc.; ECTOP EF-102, 103, 104, 105, 112, 123A, 306A, 501, 201 and 204, which are manufactured by Tohchem Products Co., Ltd.; FUTARGENT® F-100 and F150 manufactured by Neos; etc.

Specific examples of the cationic surfactants, which can disperse an oil phase including toner constituents in water, include primary, secondary and tertiary aliphatic amines having a fluoroalkyl group, aliphatic quaternary ammonium salts such as perfluoroalkyl(C6–C10)sulfone-amidepropyltrimethylammonium salts, benzalkonium salts, benzetonium chloride, pyridinium salts, imidazolinium salts, etc. Specific examples of the marketed products thereof include SARFRON® S-121 (from Asahi Glass Co., Ltd.); FLUORAD® FC-135 (from Sumitomo 3M Ltd.); UNIDYNE DS-202 (from Daikin Industries, Ltd.); MEGAFACE® F-150 and F-824 (from Dainippon Ink and Chemicals, Inc.); ECTOP EF-132 (from Tohchem Products Co., Ltd.); FUTARGENT® F-300 (from Neos); etc.

The fine particles of resin are added to stabilize the host particles of toner that are formed in the aqueous medium. Therefore, it is desirable that the fine particles of resin are added to make 10 to 90 percent covering on the surface of the host particles of the toner.

Specific examples of the particulate polymers include particulate polymethyl methacrylate having a particle diameter of from 1 μm and 3 μm, particulate polystyrene having a particle diameter of from 0.5 μm and 2 μm, particulate styrene-acrylonitrile copolymers having a particle diameter of 1 μm, PB-200H (from Kao Corp.), SGP (Soken Chemical & Engineering Co., Ltd.), TECHNOPOLYMER SB (Sekisui Plastics Co., Ltd.), SPG-3G (Soken Chemical & Engineering Co., Ltd.), and MICROPEARL (Sekisui Fine Chemical Co., Ltd.).

In addition, inorganic compound dispersants such as tricalcium phosphate, calcium carbonate, titanium oxide, colloidal silica and hydroxyapatite which are hardly insoluble in water can also be used.

Further, it is possible to stably disperse toner constituents in water using a polymeric protection colloid in combination with the inorganic dispersants and/or particulate polymers mentioned above. Specific examples of such protection colloids include polymers and copolymers prepared using monomers such as acids (e.g., acrylic acid, methacrylic acid, .alpha.-cyanoacrylic acid, .alpha.-cyanomethacrylic acid, itaconic acid, crotonic acid, fumaric acid, maleic acid and maleic anhydride), acrylic monomers having a hydroxyl group (e.g., .beta.-hydroxyethyl acrylate, .beta.-hydroxyethyl methacrylate, beta.-hydroxypropyl acrylate, (.beta.-hydroxypropyl methacrylate, .gamma.-hydroxypropyl acrylate, .gamma.-hydroxypropyl methacrylate, 3-chloro-2-hydroxypropyl acrylate, 3-chloro-2-hydroxypropyl methacrylate, diethyleneglycolmonoacrylic acid esters, diethyleneglycolmonomethacrylic acid esters, glycerinmonoacrylic acid esters, N-methylolacrylamide and N-methylolmethacrylamide), vinyl alcohol and its ethers (e.g., vinyl methyl ether, vinyl ethyl ether and vinyl propyl ether), esters of vinyl alcohol with a compound having a carboxyl group (i.e., vinyl acetate, vinyl propionate and vinyl butyrate); acrylic amides (e.g., acrylamide, methacrylamide and diacetoneacrylamide) and their methylol compounds, acid chlorides (e.g., acrylic acid chloride and methacrylic acid chloride), and monomers having a nitrogen atom or an alicyclic ring having a nitrogen atom (e.g., vinyl pyridine, vinyl pyrrolidone, vinyl imidazole and ethyleneimine). In addition, polymers such as polyoxyethylene compounds (e.g., polyoxyethylene, polyoxypropylene, polyoxyethylenealkyl amines, polyoxypropylenealkyl amines, polyoxyethylenealkyl amides, polyoxypropylenealkyl amides, polyoxyethylene nonylphenyl ethers, polyoxyethylene laurylphenyl ethers, polyoxyethylene stearylphenyl esters, and polyoxyethylene nonylphenyl esters); and cellulose compounds such as methyl cellulose, hydroxyethylcellulose and hydroxypropylcellulose, can also be used as the polymeric protective colloid.

The dispersion method is not particularly limited, and conventional dispersion facilities, e.g., low speed shearing type, high speed shearing type, friction type, high pressure jet type and ultrasonic type dispersers, can be used. Among them, the high speed shearing type dispersion methods are preferable for preparing a dispersion including grains with a grain size of from 2 μm to 20 μm. The number of rotations of the high speed shearing type disperser is not particularly limited, but is usually from 1,000 rpm (revolutions per minute) to 30,000 rpm, preferably from 5,000 rpm to 20,000 rpm. While the dispersion time is not limited, it is usually from 0.1 minute to 5 minutes for the batch system. The dispersion temperature is usually from a temperature of 0° C. to 150° C., preferably from 40° C. to 98° C. in a pressurized condition.

At the same time as the production of the emulsion, an amine (B) is added to the emulsion to be reacted with the polyester prepolymer (A) having isocyanate groups.

The reaction causes the crosslinking and/or extension of the molecular chains to occur. The elongation and/or crosslinking reaction time is determined depending on the reactivity of the isocyanate structure of the prepolymer (A) and amine (B) used, but is typically from 10 min to 40 hrs, and preferably from 2 to 24 hrs. The reaction temperature is typically from 0 to 150° C., and preferably from 40 to 98° C. In addition, a known catalyst such as dibutyltinlaurate and dioctyltinlaurate can be used. The amines (B) are used as the elongation agent and/or crosslinker.

After the above reaction, the organic solvent is removed from the emulsion (reaction product) and the resultant particles are washed and then dried. Thus, mother toner particles are prepared.

To remove the organic solvent, the entire system is gradually heated in a laminar-flow agitating state. In this case, when the system is strongly agitated in a preselected temperature range, and then subjected to a solvent removal treatment, fusiform mother toner particles can be produced. Alternatively, when a dispersion stabilizer, e.g., calcium phosphate, which is soluble in acid or alkali, is used, calcium phosphate is preferably removed from the toner mother particles by being dissolved by hydrochloric acid or similar acid, followed by washing with water. Further, such a dispersion stabilizer can be removed by a decomposition method using an enzyme.

Then a charge control agent is penetrated into the mother toner particles, and inorganic fine particles such as silica, titanium oxide etc. are added externally to obtain the toner of the present invention.

When preparing the by mixing the mother toner particles with an external additive and the lubricant L, the external additive and the lubricant L may be added individually or at the same time. The mixing operation of the external additive and the lubricant L with the mother toner particles can be carried out using a conventional mixer, which preferably includes a jacket to control the inner temperature of the mixer. Suitable mixers are V-type mixers, rocking mixers, Ledige mixers, nauter mixers and Henschel mixers. Preferably the rotational speed, mixing time and/or mixing temperature are optimized to prevent embedding of the external additive into the mother toner particles and forming a thin layer on the surface of the lubricant L.

Thus, a toner having a small particle size and a sharp particle distribution can be obtained easily. Moreover, by controlling the stirring conditions when removing the organic solvent, the particular shape of the particles can be controlled so as to be any shape between spherical and rugby ball shape. Furthermore, the conditions of the surface can also be controlled so as to be any condition between smooth surface and rough surfaces such as the surface of a pickled plum.

The thus prepared toner is mixed with a magnetic carrier to be used as a two-component developer. In this case, the toner is included in the two-component developer in an amount of from 1 part to 10 parts by weight per 100 parts by weight of the carriers. As an alternative, the toner of the present invention can be used as a one-component magnetic or nonmagnetic developer.

The lubricant supplying unit 7 including the lubricant L may be included in a process cartridge. The process cartridge includes the photoconductive element 1 having the lubricant L on the surface thereof to reduce a friction caused between the photoconductive element 1 and the cleaning blades 2*a* and 8*a*, secure excellent cleanability with the plurality of cleaning units, and achieve long-term useful lives of the photoconductive element 1 and the charging roller 3*a* due to an anti-contamination process of the charging roller 3*a*. Further, since the process cartridge included in the image forming apparatus 200 has a long-term life, a cycle of replacing the process cartridge may have a longer time period, and cause a minimum need of replacement of the process cartridge. Also, with a plurality of such process cartridges, the image forming apparatus 200 may substantially improve operability and maintainability.

The above-described exemplary embodiments have shown the image forming operations processing a plurality of toner images having different colors of toner. However, the present invention may be applied to image forming operations processing a black toner image.

The lubricant supplying unit 7 included in the process cartridge of the image forming apparatus according to the present invention presses lubricant on an area between a lubricating blade and the photoconductive drum to form a thin layer on the area. Residual lubricant remaining on the area is blocked by a lubricant blade and is returned to a lubricant container so that a necessary amount of lubricant is applied on the area. Further, by installing a lubricant supplying unit forming a thin layer of the lubricant after a cleaning unit of residual toner remaining on a surface of the photoconductive element, thereby preventing toner from being mixed with the lubricant.

Also, the toner of the present invention includes small and spherical particles that have high cleaning ability and transferability to produce an image with fine line definitions.

Numerous additional modifications and variations are possible in light of the above teachings. It is therefore to be understood that within the scope of the appended claims, the disclosure of this patent specification may be practiced otherwise than as specifically described herein.

What is claimed as new and desired to be secured by Letters Patent of the United States is:

1. An image forming apparatus, comprising:

an image bearing member configured to bear a toner image on a surface thereof;

a charging mechanism configured to uniformly charge the surface of the image bearing member;

an intermediate transfer mechanism configured to transfer the toner image from the image bearing member to an image receiver;

a cleaning mechanism configured to clean the surface of the image bearing member after the toner image is transferred to the image receiver; and a lubricant supplying mechanism configured to supply a powder lubricant contained therein to the surface of the image bearing member, the lubricant supplying mechanism comprising a lubricant housing and a lubricating blade configured to form a thin layer, the powder lubricant comprising at least one of a powder particle having a volume-based average particle diameter from greater than 0.1 mm to approximately 3.0 mm and disposed in the lubricant housing in contact with the lubricating blade prior to being supplied to the surface of the image bearing member, the lubricant supplying mechanism disposed between the cleaning mechanism and the charging mechanism.

2. The image forming apparatus according to claim 1, further comprising:

an intermediate transfer member disposed in the intermediate transfer mechanism and configured to receive the toner image from the image bearing member before transferring the toner image onto a recording medium.

3. The image forming apparatus according to claim 1, wherein the lubricant supplying mechanism comprises a supplying roller having a fibrous brush; and wherein the supplying roller is configured to apply the lubricant to the surface of the image bearing member before the lubricating blade forms the thin layer of the lubricant on the surface of the image bearing member.

4. The image forming apparatus according to claim 1, wherein the lubricant supplying mechanism comprises a supplying roller having a plurality of films; and wherein the supplying roller is configured to apply the lubricant to the surface of the image bearing member before the lubricating blade forms the thin layer of the lubricant on the surface of the image bearing member.

5. The image forming apparatus according to claim 1, wherein the cleaning mechanism comprises a plurality of cleaning units.

6. The image forming apparatus according to claim 5, wherein the plurality of cleaning units comprises a primary cleaning unit disposed upstream in a moving direction of the image bearing member, and wherein the lubricant supplying mechanism disposed downstream of the primary cleaning unit.

7. The image forming apparatus according to claim 6, wherein the cleaning mechanism comprises a secondary cleaning unit disposed downstream of the primary cleaning unit and comprising a first cleaning blade, and wherein the lubricant supplying mechanism is disposed between the primary and secondary cleaning units.

8. The image forming apparatus according to claim 7, wherein the primary cleaning unit comprises a second cleaning blade configured to exert a first predetermined contact pressure and the secondary cleaning unit comprises the first cleaning blade configured to exert a second predetermined contact pressure, the second contact pressure less than the first contact pressure.

9. The image forming apparatus according to claim 5, wherein the lubricant supplying mechanism is disposed in one of the plurality of cleaning units.

10. The image forming apparatus according to claim 1, wherein the lubricant supplying mechanism is configured to apply at least one of a vibration and a shock.

11. The image forming apparatus according to claim 1, wherein the lubricant supplying mechanism is disposed above a horizontal plane including a center position of the image bearing member.

12. The image forming apparatus according to claim 1, wherein the lubricant supplying mechanism is configured to apply the lubricant comprising a fatty acid metal salt having a metallic material and a fatty acid, wherein the metallic material comprises at least one of zinc, iron, calcium, aluminum, lithium, magnesium, strontium, barium, cerium, titanium, zirconium, lead, and manganese, and wherein the fatty acid comprises at least one of lauric acid, stearic acid, palmitic acid, myristatic acid, and oleic acid.

13. The image forming apparatus according to claim 1, wherein the charging mechanism comprises a charging member separated from the image bearing member by a predetermined distance and configure to apply a bias including a direct current superimposed by an alternate current to the charging member.

14. The image forming apparatus according to claim 1, wherein the image forming apparatus is configured to use a developer having a volume-based average particle diameter equal to or less than 10 μm and a distribution from approximately 1.00 to approximately 1.40, wherein the distribution is defined by a ratio of the volume-based average particle diameter to a number-based average particle diameter.

15. The image forming apparatus according to claim 1, wherein the image forming apparatus is configured to use a developer having an average circularity of from approximately 0.93 to approximately 1.00.

16. The image forming apparatus according to claim 1, wherein the image forming apparatus is configured to use a developer having a first shape factor from approximately 100 to approximately 180 and a second shape factor from approximately 100 to approximately 180.

17. The image forming apparatus according to claim 1, wherein the image forming apparatus is configured to use a developer having a spindle outer shape, and a ratio of a major axis r1 to a minor axis r2 from approximately 0.5 to approximately 1.0 and a ratio of a thickness r3 to the minor axis r2 from approximately 0.7 to approximately 1.0, and r1≧r2≧r3.

18. The image forming apparatus according to claim 1, wherein the image forming apparatus is configured to use a developer obtained from at least one of elongation and a crosslinking reaction of developer composition comprising a polyester prepolymer having a function group including nitrogen atom, a polyester, a colorant, and a releasing agent in an aqueous medium under resin fine particles.

19. An image forming apparatus, comprising:

means for bearing a toner image;

means for charging a surface of the means for bearing;

means for transferring a toner image from the means for bearing to an image receiver;

means for cleaning the surface of the means for bearing after the toner image is transferred to the image receiver; and means for supplying a powder lubricant to the surface of the means for bearing, the means for supplying comprising a lubricant housing and a lubricating blade configured to form a thin layer, the powder lubricant comprising at least one of a powder particle having a volume-based average particle diameter from greater than 0.1 mm to approximately 3.0 mm and disposed in the lubricant housing in contact with the lubricating blade prior to being supplied to the surface of the means for bearing, the means for supplying disposed between the means for cleaning and the means for charging.

20. The image forming apparatus according to claim 19, wherein the image forming apparatus is configured such that the image receiver comprises a recording medium that receives the toner image directly from the means for bearing and an intermediate transfer member receives the toner image from the means for bearing before transferring the toner image onto the recording medium, the intermediate transfer member disposed in the means for transferring.

21. The image forming apparatus according to claim 19, wherein the means for supplying comprises a supplying roller having a fibrous brush; and wherein the supplying roller is configured to apply the lubricant to the surface of the means for bearing before the lubricating blade forms the thin layer of the lubricant on the surface of the means for bearing.

22. The image forming apparatus according to claim 19, wherein the means for supplying comprises a supplying roller having a plurality of films; and wherein the supplying roller is configured to apply the lubricant to the surface of the means for bearing before the lubricating blade forms the thin layer of the lubricant on the surface of the means for bearing.

23. The image forming apparatus according to claim 19, wherein the means for cleaning comprises a plurality of cleaning units.

24. The image forming apparatus according to claim 23, wherein the plurality of cleaning units comprises a primary cleaning unit disposed upstream in a moving direction of the image bearing member, and wherein the means for supplying is disposed downstream of the primary cleaning unit.

25. The image forming apparatus according to claim 24, wherein the means for cleaning comprises a secondary cleaning unit disposed downstream of the primary cleaning unit and comprising a first cleaning blade, and wherein the means for supplying is disposed between the primary and secondary cleaning units.

26. The image forming apparatus according to claim 25, wherein the primary cleaning unit comprises a second cleaning blade configured to exert a first predetermined contact pressure and the secondary cleaning unit comprises the first cleaning blade configured to exert a second predetermined contact pressure, the second contact pressure less than the first contact pressure.

27. The image forming apparatus according to claim 23, wherein the means for supplying is disposed in one of the plurality of cleaning units.

28. The image forming apparatus according to claim 19, wherein the means for supplying is configured to apply at least one of a vibration and a shock.

29. The image forming apparatus according to claim 19, wherein the means for supplying is disposed above a horizontal plane including a center position of the means for bearing.

30. The image forming apparatus according to claim 19, wherein the means for supplying is configured to apply the lubricant comprising a metallic material and a fatty acid, wherein the metallic material comprises at least one of zinc, iron, calcium, aluminum, lithium, magnesium, strontium, barium, cerium, titanium, zirconium, lead, and manganese, and wherein the fatty acid comprises at least one of lauric acid, stearic acid, palmitic acid, myristatic acid, and oleic acid.

31. The image forming apparatus according to claim 19, wherein the means for charging comprises a charging member separated from the means for bearing by a predetermined distance and configured to apply a bias including a direct current superimposed by an alternate current to the charging member.

32. The image forming apparatus according to claim 19, wherein the image forming apparatus is configured to be used with a developer having a volume-based average particle diameter equal to or less than 10 μm and a distribution from approximately 1.00 to approximately 1.40, wherein the distribution is defined by a ratio of the volume-based average particle diameter to a number-based average particle diameter.

33. The image forming apparatus according to claim 19, wherein the image forming apparatus is configured to be used with a developer having an average circularity of from approximately 0.93 to approximately 1.00.

34. The image forming apparatus according to claim 19, wherein the image forming apparatus is configured to be used with a developer having a first shape factor from approximately 100 to approximately 180 and a second shape factor from approximately 100 to approximately 180.

35. The image forming apparatus according to claim 19, wherein the image forming apparatus is configured to be used with a developer having a spindle outer shape, and having a ratio of a major axis r1 to a minor axis r2 from approximately 0.5 to approximately 1.0 and a ratio of a thickness r3 to the minor axis r2 from approximately 0.7 to approximately 1.0, and r1≧r2≧r3.

36. The image forming apparatus according to claim 19, wherein the image forming apparatus is configured to be used with a developer obtained from at least one of an elongation and a crosslinking reaction of developer composition comprising a polyester prepolymer having a function group including nitrogen atom, a polyester, a colorant, and a releasing agent in an aqueous medium under resin fine particles.

37. A method of image forming, comprising:

providing an image bearing member in an image forming apparatus;

uniformly charging a surface of the image bearing member using a charging mechanism;

forming a toner image on a surface of the image bearing member;

transferring the toner image using an intermediate transfer mechanism from the image bearing member to an image receiver;

cleaning the surface of the image bearing member using a cleaning mechanism after the toner image is transferred onto the image receiver;

supplying a powder lubricant contained in a lubricant supplying mechanism onto the surface of the image bearing member, the lubricant supplying mechanism comprising a lubricant housing and a lubricating blade configured to form a thin layer, the powder lubricant comprising at least one of a powder particle having a volume-based average particle diameter from greater than 0.1 mm to approximately 3.0 mm and disposed in the lubricant housing in contact with the lubricating blade prior to being supplied to the surface of the image bearing member; and forming a thin layer using a lubricating blade.

38. The method according to claim 37, wherein the image receiver comprises a recording medium receiving the toner image directly from the image bearing member, and wherein an intermediate transfer member, which is disposed in the intermediate transfer mechanism, receives the toner image from the image bearing member before transferring the toner image onto the recording medium.

39. The method according to claim 37, wherein the lubricant supplying mechanism comprises a supplying roller having a fibrous brush; and wherein the supplying roller applies the lubricant to the surface of the image bearing member before the lubricating blade forms the thin layer of the lubricant on the surface of the image bearing member.

40. The method according to claim 37, wherein the lubricant supplying mechanism comprises a supplying roller with a plurality of films; and wherein the supplying roller applies the lubricant to the surface of the image bearing member before the lubricating blade forms the thin layer of the lubricant on the surface of the image bearing member.

41. The method according to claim 37, wherein the cleaning mechanism comprises a plurality of cleaning units.

42. The method according to claim 41, wherein the plurality of cleaning units comprises a primary cleaning unit disposed upstream in a moving direction of the image bearing member, and wherein the lubricant supplying mechanism is disposed downstream of the primary cleaning unit.

43. The method according to claim 42, wherein the cleaning mechanism comprises a secondary cleaning unit disposed downstream of the primary cleaning unit and comprising a first cleaning blade, and wherein the lubricant supplying mechanism is disposed between the primary and secondary cleaning units.

44. The method according to claim 43, wherein the primary cleaning unit comprises a second cleaning blade configured to exert a first predetermined contact pressure and the secondary cleaning unit comprises the first cleaning blade configured to exert a second predetermined contact pressure, the second contact pressure less than the first contact pressure.

45. The method according to claim 41, wherein the lubricant supplying mechanism is disposed in one of the plurality of cleaning units.

46. The method according to claim 37, wherein the lubricant supplying mechanism is configured to apply at least one of a vibration and a shock.

47. The method according to claim 37, wherein the lubricant supplying mechanism is disposed above a horizontal plane including a center position of the image bearing member.

48. The method according to claim 37, wherein the charging mechanism comprises a charging member separated from the image bearing member by a predetermined distance and configured to apply a bias including a direct current superimposed by an alternate current to the charging member.

49. A process cartridge configured to be used in an image forming apparatus, comprising:

an image bearing member configured to bear a toner image on a surface thereof;

at least one image forming component integrally mounted adjacent the image bearing member; and a lubricant supplying mechanism configured to supply a powder lubricant contained therein onto the surface of the image bearing member, the lubricant supplying mechanism comprising a lubricant housing and a lubricating blade configured to form a thin layer, the powder lubricant comprising at least one of a powder particle having a volume-based average particle diameter from greater than 0.1 mm to approximately 3.0 mm and disposed in the lubricant housing in contact with the lubricating blade prior to being supplied to the surface of the image bearing member, wherein the at least one image forming component comprises at least one of a charging unit, a developing unit and a cleaning unit, wherein the lubricant supplying mechanism is disposed between the cleaning unit and the charging unit, and wherein the process cartridge is configured to be detached from the image forming apparatus.

50. The process cartridge according to claim 49, wherein the lubricant supplying mechanism comprises a supplying roller having a fibrous brush; and wherein the supplying roller is configured to apply the lubricant to the surface of the image bearing member before the lubricating blade forms the thin layer of the lubricant on the surface of the image bearing member.

51. The process cartridge according to claim 49, wherein the lubricant supplying mechanism comprises a supplying roller having a plurality of films; and wherein the supplying roller is configured to apply the lubricant to the surface of the image bearing member before the lubricating blade forms the thin layer of the lubricant on the surface of the image bearing member.

52. The process cartridge according to claim 49, wherein the cleaning mechanism comprises a plurality of cleaning units.

53. The process cartridge according to claim 52, wherein the plurality of cleaning units comprises a primary cleaning unit disposed upstream in a moving direction of the image bearing member, and wherein the lubricant supplying mechanism is disposed downstream of the primary cleaning unit.

54. The process cartridge according to claim 53, wherein the cleaning mechanism comprises a secondary cleaning unit disposed downstream of the primary cleaning unit and including a first cleaning blade, and wherein the lubricant supplying mechanism is disposed between the primary and secondary cleaning units.

55. The process cartridge according to claim 54, wherein the primary cleaning unit comprises a second cleaning blade configured to exert a first predetermined contact pressure and the secondary cleaning unit comprises the first cleaning blade configured to exert a second predetermined contact pressure, the second contact pressure less than the first contact pressure.

56. The process cartridge according to claim 52, wherein the lubricant supplying mechanism is disposed in one of the plurality of cleaning units.

57. The process cartridge according to claim 49, wherein the lubricant supplying mechanism is configured to apply one of a vibration and a shock.

58. The process cartridge according to claim 49, wherein the lubricant supplying mechanism is disposed above a horizontal plane including a center position of the image bearing member.

* * * * *